United States Patent [19]

Halbert

[11] Patent Number: 4,911,189

[45] Date of Patent: Mar. 27, 1990

[54] MOTORIZED VAPOR DEGREASER

[76] Inventor: James B. Halbert, 15341 Texaco Ave., Paramount, Calif. 90723

[21] Appl. No.: 329,864

[22] Filed: Mar. 28, 1989

Related U.S. Application Data

[63] Continuation-in-part of Ser. No. 156,448, Feb. 16, 1988.

[51] Int. Cl.[4] ..... B08B 7/04; B08B 15/02

[52] U.S. Cl. ..... 134/57 R; 134/105; 202/170

[58] Field of Search ..... 34/57 R, 58 R, 105, 34/107; 202/170; 134/30, 31, 40, 61

[56] References Cited

U.S. PATENT DOCUMENTS

| | | | |
|---|---|---|---|
| 2,057,177 | 10/1936 | Wolff | 202/170 |
| 2,090,192 | 8/1937 | Edhofer et al. | 202/170 |
| 2,371,394 | 3/1945 | Hunter et al. | 202/170 |
| 2,860,088 | 11/1958 | Plassmeyer | 202/170 |
| 3,028,267 | 4/1962 | Edhofer et al. | 134/105 X |
| 3,632,480 | 1/1972 | Surprenant et al. | 134/105 X |
| 4,077,467 | 3/1978 | Spigarelli | 134/107 X |
| 4,101,340 | 7/1978 | Rand | 134/105 X |
| 4,558,524 | 12/1985 | Peck et al. | 134/105 X |

OTHER PUBLICATIONS

Genesolv Solvent Drying System 526-310, Allied Chemical, Printed 1/80.

Genesolv Solvent Drying System, Solvent Technical Bulletin, STB-10, Allied Chemical, 1977.

"High Performance Degreaser, Bulletin S-967" by Branson Cleaning Equipment Co., 11/81.

*Primary Examiner*—Philip R. Coe

*Attorney, Agent, or Firm*—Charles H. Thomas

[57] ABSTRACT

An immersion type vapor degreaser has a tank divided by an upright partition into an immersion chamber and a boiling chamber and defining a vapor zone thereabove. A roof panel on the tank covers the top of the boiling chamber, and the open mouth of the tank is provided with condensation means above the immersion chamber for condensing vaporized degreasing solvent. A drip plate is positioned above the partition, and is movable to cover the immersion chamber at an angle sloping upwardly from the partition and extending out over the immersion chamber. A motor drive is provide for moving said drip plate to an open position to expose the immersion chamber in response to an open signal. The purpose of this arrangement is to drastically decrease the vapor interface with the atmosphere n so as to reduce solvent emission. The function of the drip plate is to channel dirty solvent which condenses and drops from dirty parts back into the boiling chamber.

17 Claims, 16 Drawing Sheets

MOTORIZED VAPOR DEGREASER

BACKGROUND OF THE INVENTION

This application is a continuation-in-part of U.S. Patent Application Ser. No. 156,448 filed Feb. 16, 1988.

1. Field of the Invention

The present invention relates to an improvement in an immersion-type vapor degreaser.

2. Description of the Prior Art

Vapor degreasers are widely used to clean grease from metal articles of manufacture. Metal articles of manufacture are often coated with grease which is applied to the metal so that the metal will not oxidize when stored prior to use. However, when the metal parts are to be used, the grease must be removed. Vapor degreasers are employed to clean grease coated upon a variety of articles of manufacture, including such items as metal electrical parts.

Vapor degreasers effectuate cleaning through the condensation of hot solvent vapor on the colder metal parts. The vapor degreasing substance is often an organic solvent which, if released into the atmosphere, represents a toxic waste and is a source of air pollution. Several different types of vapor degreasers are commercially employed to remove grease from metal parts utilizing vaporized organic solvents, and care must be exercised to minimize the extent to which vapor fumes are released into the atmosphere.

Open top vapor degreasers provide a bath of heated solvent having an open top. Open top vapor degreasers are batch loaded, so that they clean only one work load at a time. One very significant disadvantage of conventional open top vapor degreasers is that they emit large quantities of organic pollutants into the atmosphere. It is estimated that open top vapor degreasers emit two hundred thousand metric tons of organic solvents into the atmosphere per year. This is approximately thirty percent of the national total of degreasing emissions.

A conventional open top immersion-type vapor degreaser has two chambers or tanks located side by side and separated by a vertical partition. One of the chambers is a boiling chamber and the other is an immersion camber. The boiling chamber is used to produce clean vapors and solvent. For precision cleaning of grease from metal parts using an open top, immersion-type vapor degreaser, the parts are first placed in a basket and lowered into the vapor zone above the boiling chamber so that condensation can commence. Hot vapors condense on the cold parts and drip into the boiling chamber, carrying away gross contaminants from the parts.

The solvent that condenses on the parts both dissolves grease a oils and provides a washing action to clean the parts. The selected solvents boil at much lower temperatures than do the contaminants. Thus, the solventcontaminant mixture in the degreaser boils to produce an essentially pure solvent vapor.

When the temperature of the parts rises to approach the boiling point of the degreasing substance, condensation on the parts ceases. The parts are then slowly withdrawn from the degreaser. Residual liquid solvent on the parts rapidly evaporates as the parts are removed from the vapor zone. The cleaning action is often increased by spraying the parts with solvent at a level below the vapor level, or by moving the basket laterally and then lowering it into a liquid level bath in an immersion chamber.

When the basket of parts s withdrawn from a vapor degreaser, the vapor which does not otherwise condense on the metal parts is condensed by a cooling coil or vapor trap extending about the inner perimeter of the wall of the vapor degreasing tank. Condensed vapors are recovered by means of a gutter and re drained to a water separator and a distillation reservoir. The water separator is employed to separate water from the condensate products, and to store fresh solvent for spray rinsing of the parts to be cleaned.

An immersion chamber is laterally separated from the boiling chamber by a partition and is used for cleaning the metal parts after those parts have been suspended above the boiling chamber and after a portion of the grease has been removed by solvent condensing on the parts to be cleaned. Once the metal parts have been exposed to the heated vapors to remove a portion of the grease, they are moved laterally from above the boiling chamber to above the immersion chamber and are lowered into the immersion chamber where the remainder of the grease is removed. The metal parts are cleaned either by soaking or through the use of ultrasonic cleaning equipment. Precleaning of the parts over the boiling chamber is necessary to prevent the immersion chamber from becoming overly contaminated.

A typical, conventional vapor degreaser is designed to produce and contain solvent vapor. At least one section of the tank is equipped with a heating system that uses steam, electricity or fuel combined to boil the solvent. As the solvent boils, the dense solvent vapors displace air within the equipment. The level to which the pure vapor rises is controlled by condenser coils located on the upper side walls of the degreaser. These coils are supplied with a coolant, such as water and extend around the entire inner surface of the degreaser although in some smaller equipment the condensing unit is limited to a spiral coil at one end of the degreaser. Most vapor degreasers are also equipped with a cooling jacket which provides additional cooling and prevents convection of solid vapors up hot degreaser walls. Typical degreaser solvents include perchloroethylene, 1,1,1-trichloroethane, trichlortrifluoroethane and methylene chloride.

The cooling coils in a vapor degreaser must be placed some distance below the top edge of the degreaser to protect the solvent vapor zone from disturbances caused by air movement around the equipment. The distance between the top of the vapor zone and the top of the degreaser is called the freeboard and is generally established by the location of the condenser coils. By law, the freeboard must be seventy five percent of the width of the degreaser. A higher freeboard than is required by law will further reduce solvent emissions. However, a very high freeboard creates difficulty in moving parts into and out of a degreaser to such an extent that those difficulties outweigh the benefits of decreased emissions.

Nearly all vapor degreasers are equipped with a water separator. The condensed solvent and moisture are collected in a trough below the condensed coils and are directed to the water separator. The water separator is a simple container which allows the water, which is immiscible and less dense than the solvent, to separate from the solvent and decant from the system while the solvent flows from the bottom of the water separator back into the degreaser.

Since the top of an open top degreaser is in direct communication with the atmosphere, a certain amount of solvent vapor is lost each time the vapor degreaser is operated. The amount of solvent a vapor degreaser loses is a direct function of the square footage of vapor area encompassed by the vapor degreaser mouth which is exposed to the atmosphere. This solvent loss is typically quantified as a number of pounds per square inch, and is called the diffusion loss.

Diffusion is the escape of solvent vapors from the vapor zone out of the degreaser. Solvent vapors mix with air at the top of the vapor zone. This mixing increases with drafts and with disturbances from cleaned parts being moved into and out of the vapor zone. Solvent vapors diffuse into the atmosphere. The solvent losses include the convection of warm solvent-laden air upwards out of the degreaser.

The extent of diffusion can be reduced proportionately by proportionately reducing the number of square feet of vapor area exposed to the atmosphere. Heretofore, however, immersion-type vapor degreasers have required the area above both the boiling chamber and the immersion chamber to be open to the atmosphere, as metal baskets carrying the parts to be cleaned must be moved laterally from a location above the boiling chamber to a location above the immersion chamber.

The most popular open top vapor degreasers range in size from table top models with open top dimensions of one foot by two feet up to units which are one hundred ten feet long and six feet wide. A typical open top vapor degreaser is about three feet by six feet long. An average open top vapor degreaser emits about 2.5 kilograms of solvent vapor per hour per square meter of opening (0.5 pounds per hour per square foot). This estimate is derived from national consumption data on vapor degreaser solvents and from seven environmental protection agency emission tests. An average open top vapor degreaser has an open top area of about 1.67 square meters, which is about eighteen square feet. In such a vapor degreaser, a typical emission rate is about 4.2 kilograms per hour or 9,500 kilograms per year (9 pounds per hour or 10 tons per years).

Historically, degreasers of the typical size and smaller have been supplied with single piece, unhinged metal covers. Open top vapor degreasers operate manually and are generally used for only a small portion of the workday or shift. The inconvenience of using the covers has resulted in general disuse, or at best use only during prolonged periods when the degreaser is not operated, for example, on weekends. More recently, small open top vapor degreasers have been equipped with manually operated roll-type plastic covers, plastic curtains, or hinged and counterbalanced metal covers. Larger units have been equipped with segmented metal covers. Most of the larger open top vapor degreasers (200 square feet or larger) and some of the smaller degreasers have had manually controlled powered covers.

Some vapor degreasers employ lip exhausts which are designed to capture solvent vapors escaping from the degreasers and carry them away from the operating personnel. A system with a lip exhaust employs a blower and intake openings about the interior lip of the vapor degreaser above the condensing unit. However, lip exhausts do disturb the vapor zone and thereby tend to increase solvent losses. For properly designed exhaust systems, the covers of the vapor degreaser are seated and close below the level of the lip exhaust inlet.

Open top vapor degreasers are usually less capital intensive than conveyorized systems, but more capital intensive than cold cleaning equipment. Open top vapor degreases are generally located near the work which is to be cleaned at convenient sites within a plant, whereas conveyorized vapor degreasers tend to be located at central cleaning stations thereby requiring the relocation of parts for cleaning.

Open top vapor degreasers are primarily used in metal working plants. Open top vapor degreasers are more likely to be used in larger plants than are cold cleaners. Vapor degreasers are generally not used for ordinary maintenance of metal parts, because cold cleaning can usually perform this function at lower cost. An exception, however, is maintenance cleaning of electrical parts. Such cleaning is typically performed with a vapor degreaser because a high degree of cleanliness is required and such parts are typically intricately designed. Unlike cold cleaners, open top vapor degreasers lose a relatively small portion of their solvent in the waste material and as liquid carry-out. Rather, most of the emissions are those vapors that diffuse out of the degreaser.

SUMMARY OF THE INVENTION

In one broad aspect the present invention is an improvement to an immersion-type vapor degreaser having a tank and defining a boiling chamber, an immersion chamber separated from the boiling chamber by an upright partition, and a vapor zone above the immersion chamber. According to the improvement of the invention, a roof is provided on the tank to extend over the boiling chamber at a distance above the partition. A condensation means is located on the tank above condensing vaporized degreasing solvent, and a drip plate is positioned above the partition and beneath the vapor zone. An electric motor and a positioning means are provided. The positioning means is responsive to actuation of the electric motor and is coupled to the drip plate for alternatively positioning the drip plate to cover the immersion chamber at an angle sloping upwardly from the partition over the immersion chamber and beneath the vapor zone and for positioning the drip plate in an open position to uncover the immersion chamber.

In a first preferred embodiment, the drip plate is hinged to the tank at a horizontal axis located above the partition an at the bottom of the vapor zone. The drip plate is rotatable between a raised closed position in which a first portion of the drip plate extends at an incline away from the partition out over the immersion chamber, and alternatively, a lowered, open position folded toward the partition within the immersion chamber. A biasing means, in the form of a counterweight on a second portion of the drip plate located on the opposite side of the axis from the first portion of he drip plate, biases the drip plate toward the raised, closed position.

In a second embodiment the drip plate is a sliding drip plate which is also operated by the electric motor. The sliding drip plate does not create as much turbulence in the vapor zone in moving between its open and closed positions, so it can be moved to the closed or open position at greater speed than the pivoted plate arrangement. Contaminants are not carried from the surface of the sliding drip plate into the immersion chamber because the top surface of the sliding plate is never immersed into the immersion chamber as is the pivoted drip plate.

A sequence and position control means may be provided by a microprocessor. Bath and spray cycle times are controlled by an operator via keyboard entries. Uniformity in sequential batch processing can be provided by use of the microprocessor driven sequence and position control means. By constructing an immersion-type vapor degreaser according to the invention, the area directly above the boiling chamber can be closed off from communication with the atmosphere since the parts to be cleaned do not need to be positioned directly above the boiling chamber. The drip plate prevents contaminated, condensed solvent from droping into the immersion chamber, and channels the contaminated solvent down the inclined drip plate across the vertical plane of the separating partition and back into the boiling chamber or water separator. Since the entire area above the boiling chamber does not have to be open to the atmosphere, the rate of diffusion of solvent emissions from an improved immersion-type vapor degreaser according to the invention is greatly reduced.

In another broad aspect of the present invention may be considered to be an improved method of cleaning objects in a vapor degreaser having a tank defining a boiling chamber and an immersion chamber separated by an upright partition. A drip plate is provided for covering the immersion chamber. A positioning means is provided for moving the drip plate to a closed position to cover the immersion chamber and to an open position to expose the immersion chamber.

According to the invention, the boiling chamber is covered with a roof to reduce the area of the tank that is open to the atmosphere. The drip plate is mounted at a location above the top edge of the partition. The drip plate is biased toward a closed position covering the immersion chamber at an inclined orientation to drain solvent from its top surface into the boiling chamber. Objects to be cleaned are positioned in a basket above the immersion chamber and above the drip plate in its closed position to expose the basket of objects to be cleaned to vapor rising from the boiling chamber. The roof above the boiling chamber deflects the rising vapors laterally toward the basket located above the immersion chamber and above the drip plate. Vapor then condenses on the objects to be cleaned and falls onto the drip plate, rather than into the immersion chamber. This contaminated condensed cleaning liquid is then returned to the boiling chamber. The basket of objects is then lowered into the immersion chamber, where the objects are soaked or subjected to ultrasonic cleaning. The basket is then raised out of the immersion chamber, and the drip plate is returned to its closed position.

In a preferred embodiment of the invention, the motor drive pivots the rotatably mounted drip plate into the immersion chamber before the basket is lowered, so that the parts basket does not contact the drip plate. Contaminants, such as small metal particles which could result from the basket scraping against the pivoted drip plate top surface are avoided by the positive sequence control provided by the motor drive.

The objects are cleaned by ultrasound or by soaking in the immersion chamber. Ultimately, the basket is raised out of the immersion chamber. Preferably, the drip plate is provided with a counterweight which biases the drip plate toward its closed position. However, some means is preferably provided for temporarily holding the drip plate in its open position after the parts basket is raised. This prevents the pivoted drip plate of the preferred embodiment of the invention from rising out of the immersion chamber and scraping the parts basket as the basket is raised from the immersion chamber. This function is performed by maintaining tension on the drive cable. After the parts basket is raised, the motor drive releases tension on the drive cable allowing the counterweight to cause the drip plate to swing back upwardly to its inclined, closed and raised position without making any contact with the parts basket.

The drip plate is preferably formed as a flat slab having transverse opposite edges orientated perpendicular to the axis of rotation. Channeling lips extend upwardly from the slab at the opposite edges which are inclined upwardly when the drip plate is in its closed, raised position.

The biasing means for the pivoted drip plate is preferably a counterbalancing weight formed as a flat strip that extends downwardly from the slab above the boiling chamber. The counterbalancing weight is orientated perpendicular to the flat slab. The portion of the drip plate extending out from the partition over the immersion chamber extends a distance preferably no greater than the elevation of the horizontal axis above the bottom of the immersion chamber so that the drip plate can assume a position folded flat against the partition when the parts to be cleaned are lowered into the immersion chamber.

An embodiment of the invention which employs a sliding plate may also employ a counterweight. The edges of the sliding plate may be formed to drain into a weir formed by the slide guides that support the lower edges of the sliding plate. This guides contaminated solvent that runs off of the edges of the surface of the drip plate into the boiling chamber.

The invention may be described with greater clarity and particularity by reference to the accompanying drawings.

DESCRIPTION OF THE EMBODIMENT AND IMPLEMENTATION OF THE METHOD

Figure 1:
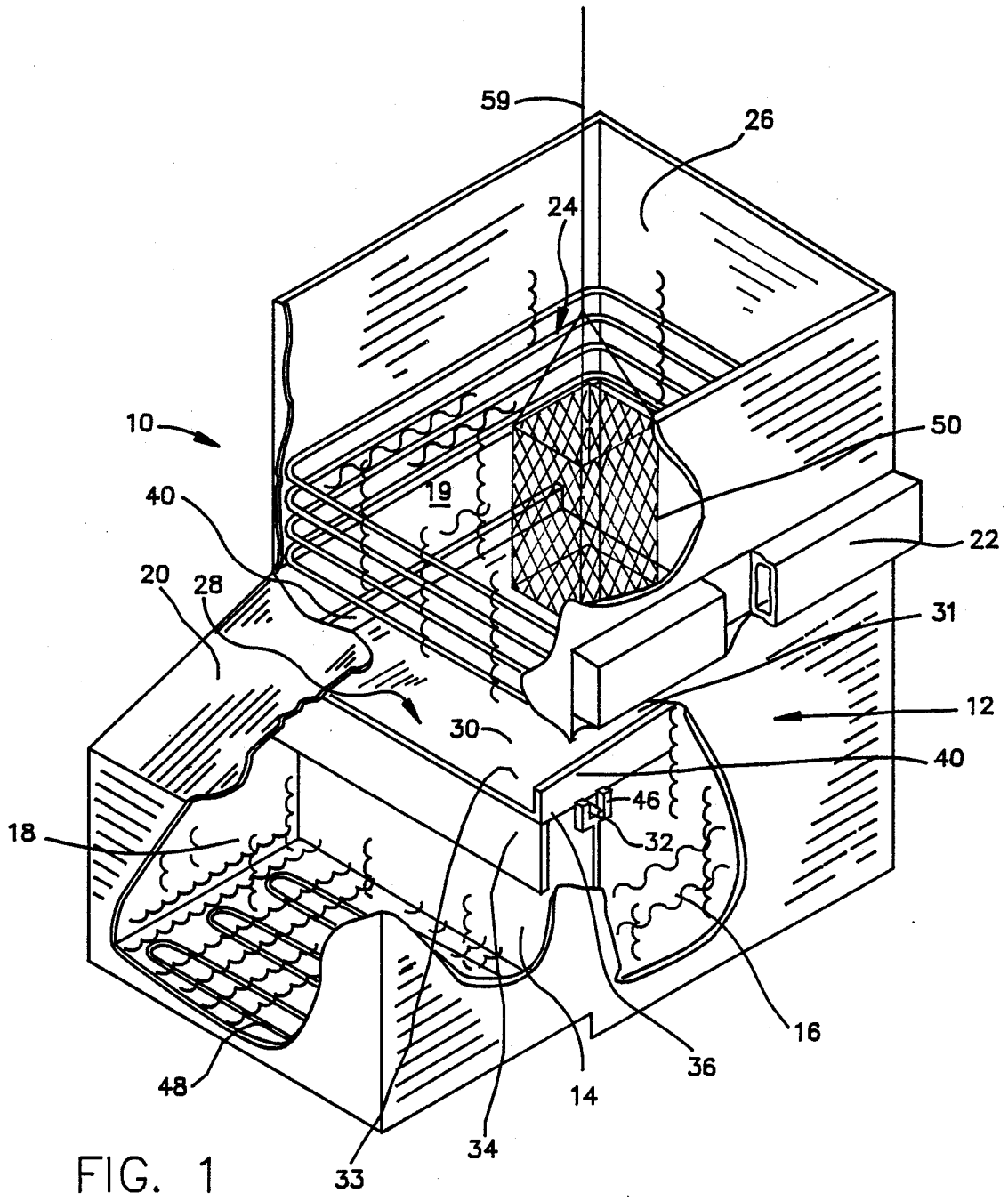
FIG. 1 is a perspective view illustrating an immersion-type vapor degreaser according to the invention with a parts basket suspended above the immersion chamber.
Figure 2:
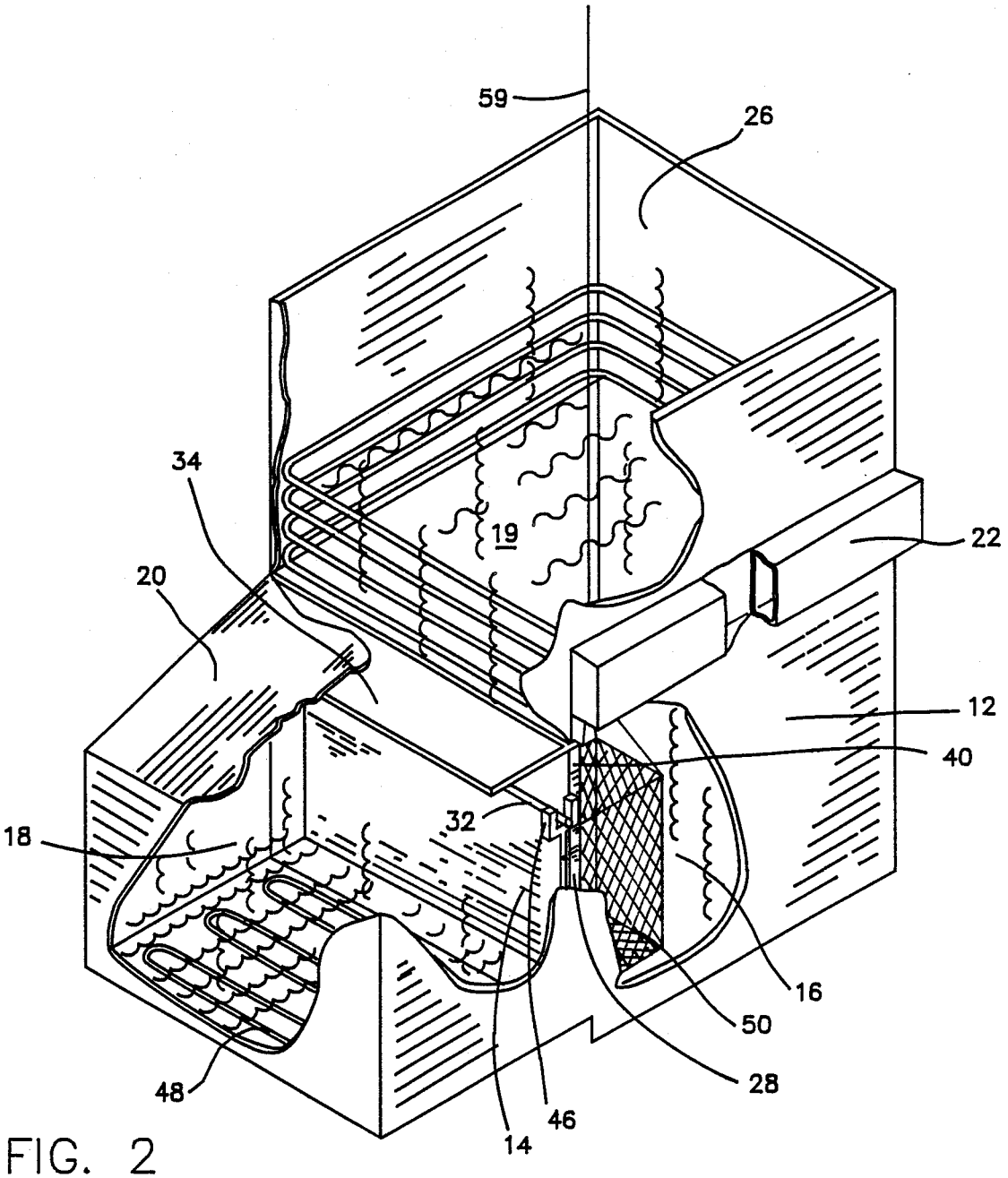
FIG. 2 is a perspective view of the vapor degreaser of FIG. 1 with the parts basket lowered into the immersion chamber.
Figure 3:
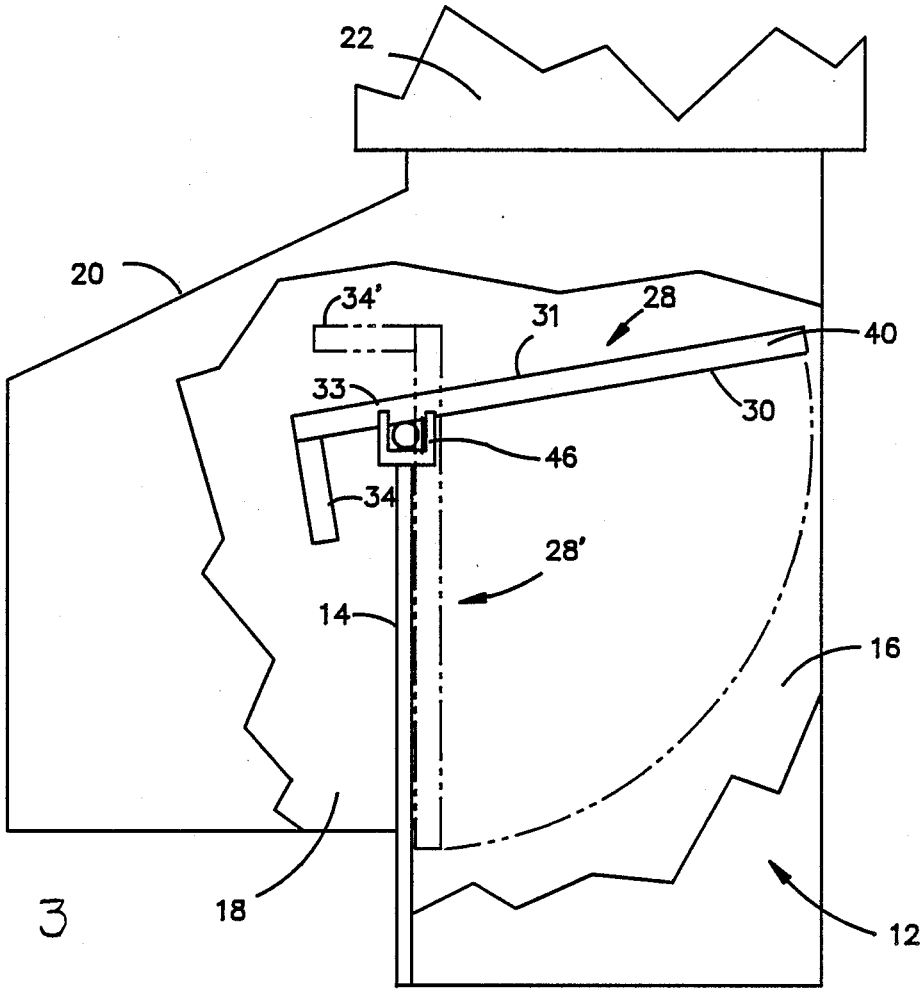
FIG. 3 is a side elevation view of the vapor degreaser of FIGS. 1 and 2 illustrating the operation of a pivoted drip plate.

FIGS. 1–3 illustrate an immersion-type vapor degreaser indicated generally at 10. The vapor degreaser 10 is comprised of a tank 12 which is divided by an upright partition 14 into an immersion chamber 16, a boiling chamber 18, and a vapor zone 19. The tank 12 includes a roof panel 20 located above the boiling chamber 18. The roof panel 20 covers the top of the boiling chamber 18 and is inclined upwardly in the direction of the immersion chamber 16 as illustrated. Condensation means in the form of a conventional cooling jacket 22 and condensing coils 24 are located on the tank 12 above the immersion chamber 16. The cooling jacket 22 and the condensing coils 24 condense vaporized degreasing solvent below the freeboard region of the tank 12 which is indicated at 26.

According to the improvement of the invention, a drip plate 28 is provided and is formed of a flat slab or sheet 30 of 18 gauge stainless steel number 304 approximately seventeen inches long and fourteen and one half inches wide. Tee drip plate 28 is hinged upon a horizontal axis at axle 32 directly above the partition 14 and beneath the vapor zone 19. The axle 32 is a cylindrical rod three eighths of an inch in diameter and is welded to the underside of the drip plate 28 to protrude beyond the edges 36 thereof a distance of one half of an inch at each end. The axle 32 serves as a demarcation between a first portion 31 and a second portion 33 of the drip plate 28. The first portion 31 is about eleven and one half inches in width and the second portion is about three inches in width. A counterbalancing means 34 in the form of flat strip of 18 gauge stainless steel number 304 is located on the edge of the underside of the second portion 33 of the drip plate 28 above the boiling chamber 18 to bias the drip plate to the closed disposition depicted in FIG. 1 and in solid lines in FIG. 3. In this closed position the first portion 31 extends out over the immersion chamber 16 at an angle sloping upwardly from the axle 32.

Figure 4:
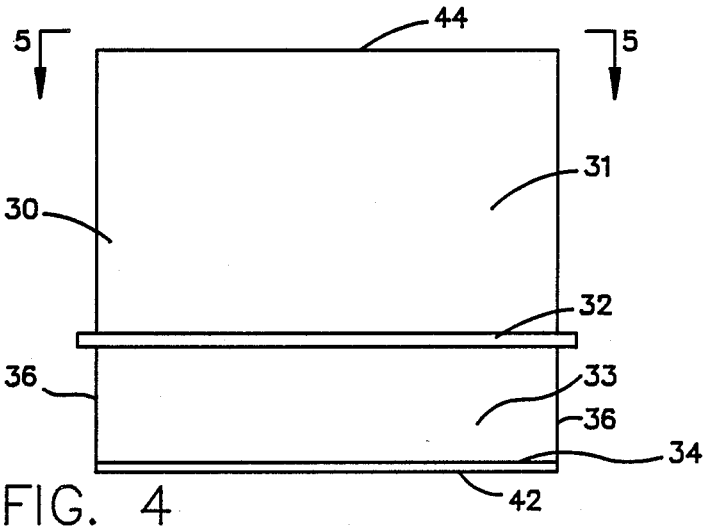
FIG. 4 is an isolated plan view of the underside of the pivoted drip plate showing the axle and the counterbalancing strip employed in FIG. 3.
Figure 5:
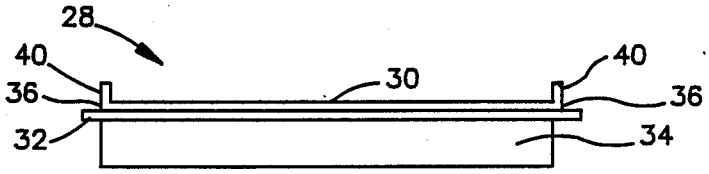
FIG. 5 is an elevation end view of a pivoted drip plate taken along line 5—5 of FIG. 4.

The drip plate 28 is depicted with the axle 32 and the counterbalancing strip 34 in isolation in FIGS. 4 and 5. The slab or sheet 30 of the drip plate 28 has opposite transverse edges 36 which extend outwardly from the axle 32 perpendicular thereto. The first portion 31 of the drip plate 28 extends out over the immersion chamber 16 a distance no greater than the elevation of the horizontal axle 32 above the bottom of the immersion chamber 16 upright partition 14. As illustrated in FIG. 5, channeling means in the form of upturned lips 40 are formed at the opposite edges 36 of the sheet 30.

The axle 32 is preferably carried within generally U-shaped brackets 46 which are located atop the partition 14. The U-shaped brackets 46 are preferably about one inch in height and width and three eighths of an inch in thickness. A central slot about three eighths of an inch in width is defined in the upper edge of each of the brackets 46 to receive an end of the axle 32. The axle 32 thereby rests within the slots defined in the brackets 46 at the opposite ends of the upper edges of the partition 14. The brackets 46 are likewise formed of stainless steel number 304.

The procedure for cleaning objects in the improved vapor degreaser 10 is illustrated in FIGS. 1–3. As illustrated in FIG. 1, the roof 20 covers the boiling chamber 18 which is heated by heating coils 48. The heating coils 48 boil the cleaning solvent, the vapors of which are deflected laterally by the roof 20 into the vapor zone 19 above the immersion chamber 16. A stainless steel basket 50 containing metal parts to be cleaned is suspended by cable 59 above the immersion chamber 16 and above drip plate 28 that is hinged upon axle 32 above partition 14. The ends of axle 32 rest in the brackets 46. The counterbalancing strip 34 located on the underside of the sheet 30 above the boiling chamber 18 biases the drip plate 28 toward its closed position so that the first portion 31 thereof extends at a inclination upwardly from the axle 32 out over the immersion chamber 16. The objects in the basket 50 are thereby exposed to vapor rising from the boiling chamber 18.

Vapor condenses on the objects in the basket 50 and falls onto the flat slab 30 of the drip plate 28. Since the drip plate 28 is inclined upwardly from axle 32, as illustrate in solid lines in FIG. 3, the condensed solvent carrying the contaminants from the objects in the basket 50 flows down the drip plate 28 from right to left as viewed in FIG. 3 and returns to the boiling chamber 18. The lips 40 at the opposite edges 36 of the flat sheet 30 prevent the condensed and contaminated solvent from flowing laterally into the immersion chamber 16, and direct the flow of condensed solvent into the boiling chamber 18.

As the parts to be cleaned in the basket 50 are exposed to the rising solvent vapors from the boiling chamber 18, their temperature approaches the temperature of the vaporized solvent. The extent of condensation of the solvent therefore diminishes, although by this time much of the gross contamination has been removed from the contents of the basket 50. To further clean articles in the basket 50, the basket is then lowered by the cable 59.

In the simplest embodiment of the invention depicted in FIGS. 1–3 and 7, the doors of a conventional cabinet (not shown) surrounding the open top of the vapor degreaser 10 are first manually opened by an operator. The basket 50 is then loaded with parts to be cleaned. The cabinet doors are then closed. The operator then actuates a motor 53 to lower the basket 50 into the vapor zone 19.

Lowering of the basket 50 on the line 59 is halted by a suitable position sensing means, such as a limit switch, an encoder, or a photosensor. The basket 50 is then held in the vapor zone 99 for a rinse cycle, during which time vaporized solvent from the boiling chamber 18 rises into the vapor zone 19 and condenses on the parts in the basket 50. The condensed solvent drips onto the drip plate 28, carrying much of the contaminating grease with it. The incline of the drip plate 28 in its closed position channels the contaminated solvent back into the boiling chamber 18. Following the rinse cycle the operator then actuates the motor 53 thereby providing it with an open signal.

The axle of the motor 53 turns a take-up reel or drum 54, which pulls up on the cable 55 and winds the cable onto the drum 54. This causes the portion 31 of the drip plate 28 to rotate downwardly about the axle 32 and into the immersion chamber 16 as indicated in dotted lines in FIG. 3. Rotation of the motor 53 may be halted by a limit switch which may be the type depicted in FIG. 14 or controlled by deactuation of the motor 53. The drum 54 is equipped with a one way clutch, so that termination of the open signal does not release the drum 54. The drip plate 28 is thereby held in the open position indicated at 28' in FIG. 3. The parts in the basket 50 which re submerged in solvent in the immersion chamber 16 are then cleaned ultrasonically or by circulation of solvent.

The position of the counterbalancing weight, with the drip plate 28 in the open position 28', is indicated in FIG. 3 at 34'. When the basket 50 is in the immersion chamber 16 the solvent in the immersion chamber 16 dissolves the remaining contaminants from the parts to be cleaned in the basket 50. However, the solvent within the immersion chamber 16 does not become overly contaminated, since a very significant portion of the contaminants were removed prior to the step of immersion by exposure of the basket 50 and its contents to the rising vapor from the boiling chamber 18.

It should be noted that the only area of the vapor degreaser 10 which is exposed to the atmosphere is the area directly above the immersion chamber 16. The roof 20 covers the boiling chamber 18. The system of the invention thereby reduces the square footage of the vapor area exposed to the atmosphere without contaminating the solvent in the immersion chamber to any greater an extent than occurs in conventional vapor degreasers.

Once the articles to be cleaned in the basket 50 have been immersed for a time sufficient to remove all of the contaminants, the basket 50 is raised by means of the cable 59. As soon as the basket 50 clears the closed position of the drip plate 28, the clutch of the drum 54 is released. The weight of the counterweight 34 is thereupon able to return the drip plate 28 to its raised, closed position. The counterbalancing strip 34 causes the tilt plate 28 to rotate in a counter-clockwise direction, as viewed in FIG. 3, and return to the inclined, raised and closed position indicated in that drawing figure The counterbalancing strip 34 biases the tilt plate to an upwardly inclined position at an angle of preferably at least about five degrees.

As soon as the basket clears the surface of the solvent in the immersion chamber 16, the parts are sprayed with a solvent spray. After being held in the vapor zone for about two or three minutes, the basket 50 is raised up into the cabinet. The cabinet doors are opened and the cleaned parts are unloaded from the basket.

Figure 6:
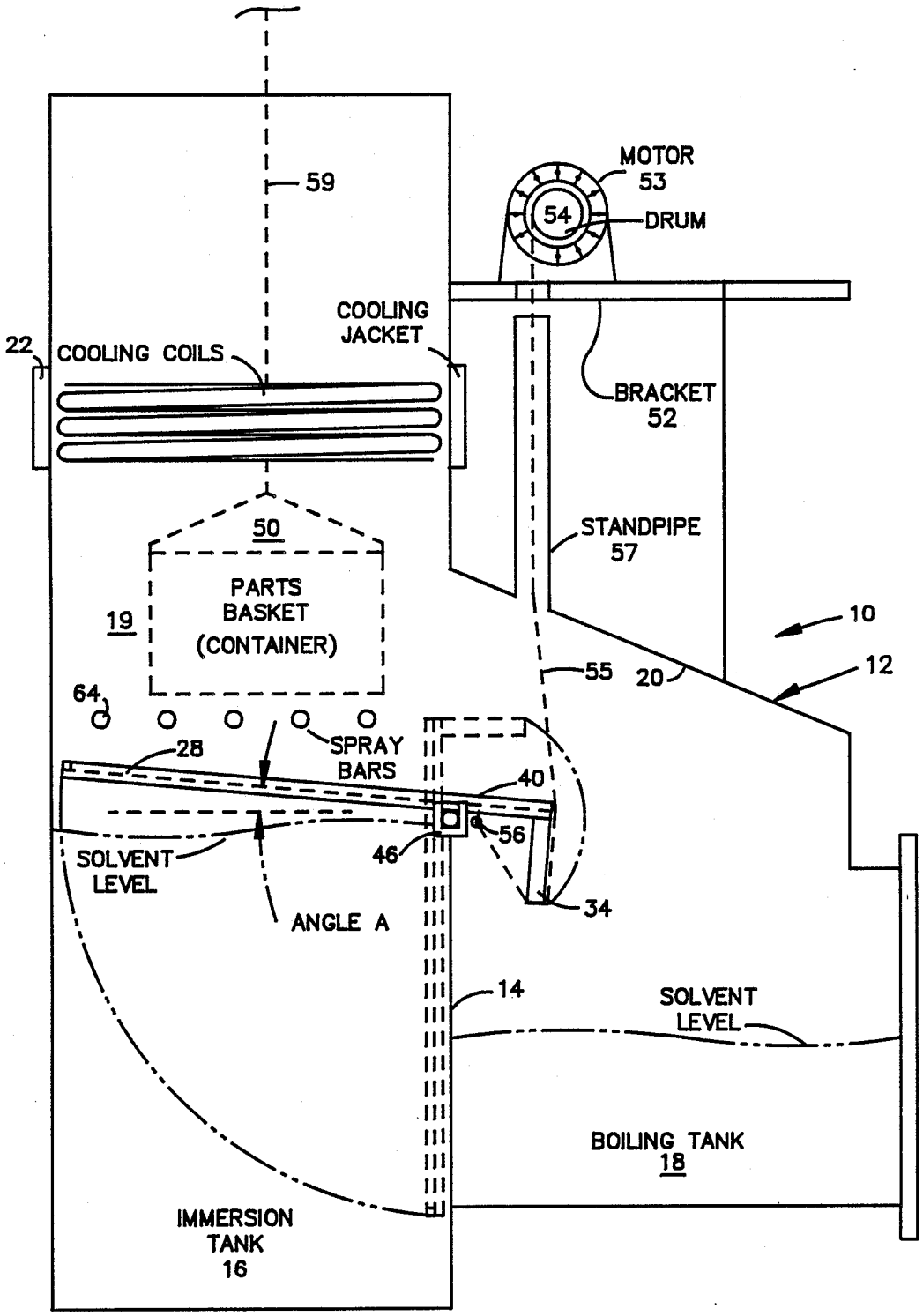
FIG. 6 is a side elevation view of the vapor degreaser of FIG. 1 and 2 illustrating the operation of a pivoted drip plate with a motor positioned on a bracket and driving a drum to retract a cable to lower the drip plate.
Figure 7:
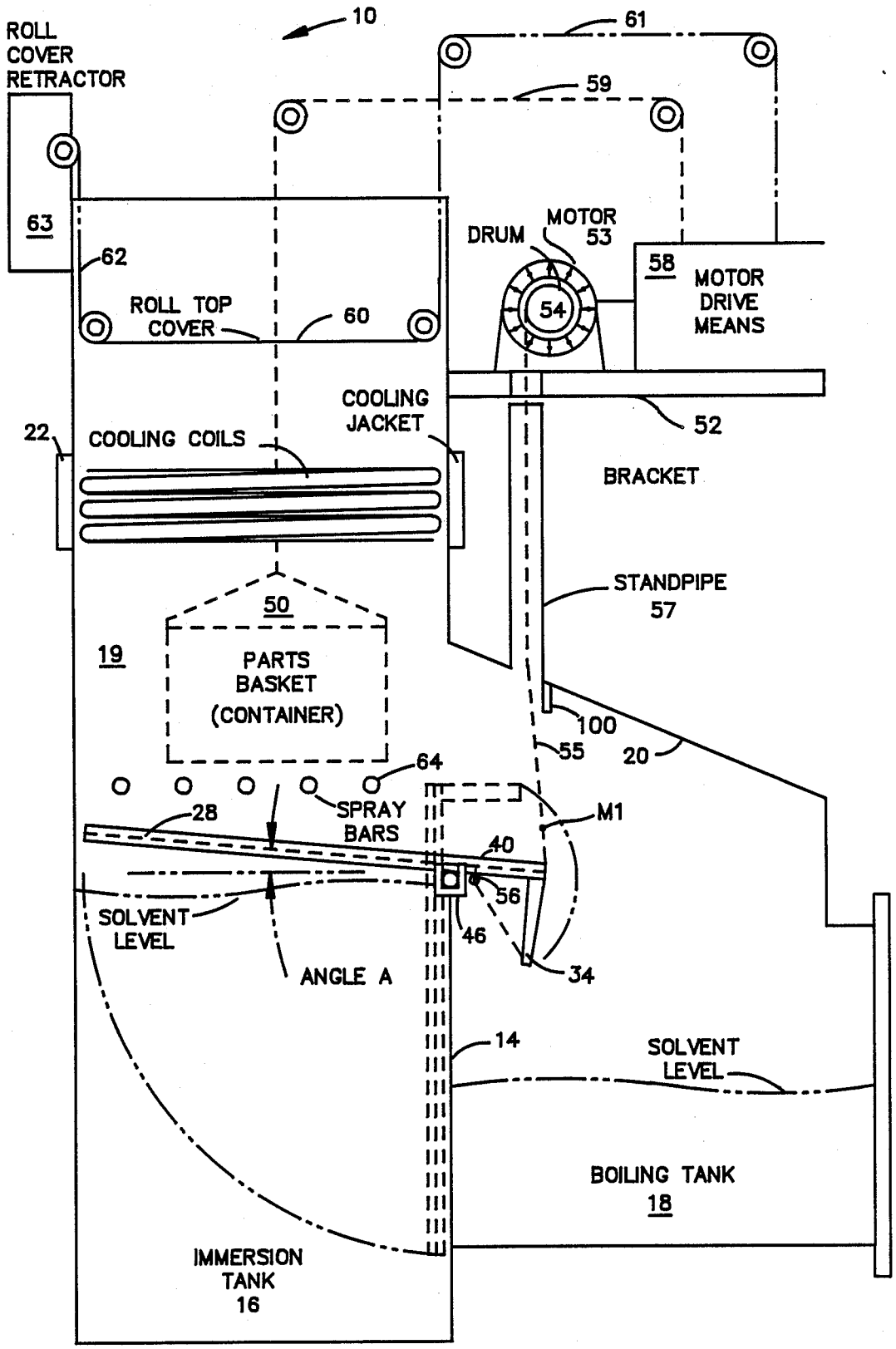
FIG. 7 is a side elevation view of the vapor degreaser of FIGS. 1 and illustrating the operation of a pivoted drip plate with motor drive means and also a motor driven roll top cover.
Figure 8:
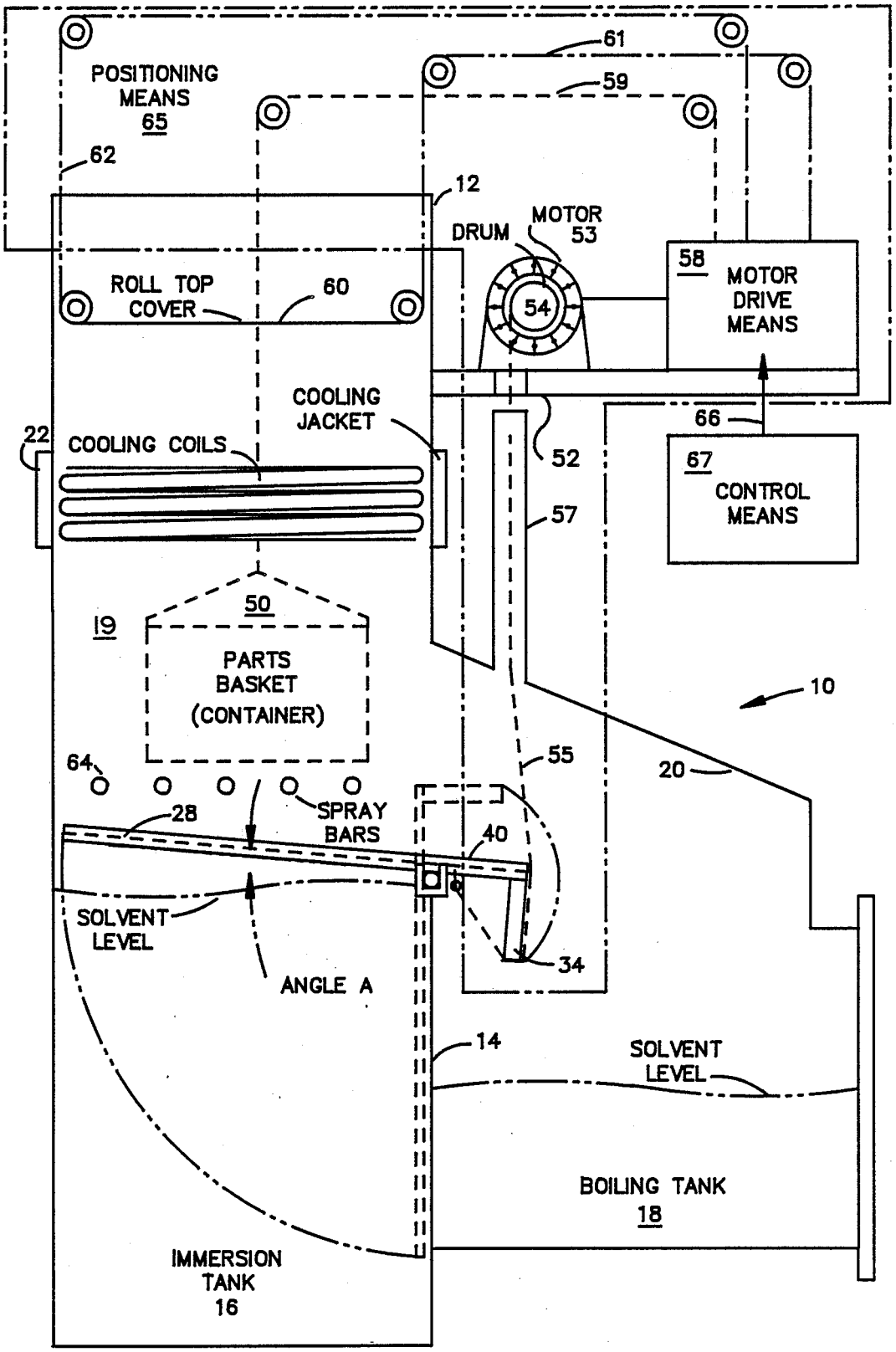
FIG. 8 is a side elevation view of the vapor degreaser of FIGS. 1 and 2 in which a control means governs operation of the motor.

FIGS. 6, 7 and 8 show increasingly complex alternative embodiments of the immersion-type vapor degreaser 10 using a pivoted drip plate 28 as shown in FIG. 1 and 2. In the embodiment of FIG. 6, basket 50 is manually lowered by chain 52 as required. A motor 53 for driving the drip plate 28 is mounted on and supported by a plate or bracket 52 attached to the tank 12.

The pivoted drip plate 28 is lowered by motor 53. Motor 53 turns the cable drum 54 to retract the plate operating cable 55. The plate operating cable 55 is anchored to the bottom of the pivoted drip plate at ring 56. The plate operating cable 55 passes around the lower edge of counterweight 34 and then extends upwardly through a standpipe 57 for retrieval on cable drum 54. The standpipe 57 terminates immediately beneath the bracket 52 which extends outwardly from the upper portion of the tank 12.

The standpipe is a metal tube of minimal dimension for free passage of the plate operating cable 55. The cross sectional area of the standpipe tube 57 is as small as possible so as to reduce the vent area of the standpipe 57 as it emerges above the roof 20 above the boiling chamber 18. The thermal path from the tank and cooling coils to the standpipe 57 is controlled by the design of the tank to ensure that the region of the standpipe above the cooling jacket 22 is cooled to condense solvent vapor passing up into the standpipe 57 from the boiling chamber roof entry point.

A modified embodiment of the invention uses a motor that is reversible. In such an embodiment a first switch closure by an operator causes the motor to rotate in a direction to retrieve the cable and lower the pivoted drip plate 28. A second switch closure by the operator causes the motor to operate in the reverse direction allowing the cable to pay out add allowing the first portion 31 of the drip plate 28 to rise in response to the restoring torque applied by the counterweight 34. A gear box or worm gear drive provides a shaft speed reduction from the motor 53 tothe drum 54. The drum 54 stops as power to the motor 53 is interrupted.

FIG. 7 shows the embodiment of FIG. 6 modified by the addition of a motor drive means 58 to provide sequential control for raising parts basket 50 by basket cable 59 and for retrieving roll top cover 60 by roll top cable 61. The embodiment of FIG. 7 contemplates the application of a sequential timing controller to time and control the sequence of operation. The sequence of operation of the embodiment of FIG. 7 starts with an operator loading parts in the parts basket 50 or with the basket receiving a charge of parts from a manual or automated dispenser. A roll top cover motor (not shown) within motor drive means 58 is actuated to open the roll top cover by retracting cable roll top cable 61.

A basket motor (not shown) within motor drive means 58 is actuated to lower the parts basket 50 from the freeboard area 26 above the roll top cover 60 to the position shown in the vapor zone 19. The trailing roll top cover cable 62 is kept in tension by the spring restored roll top retractor 63.

The parts basket 50 is stopped in the vapor zone 19 during the vapor rinse interval. During the vapor rinse interval contaminated solvent is washed from the parts ontothe drip plate 28 and then drained from the drip plate into the boiling chamber 18. After completion of the vapor rinse, the pivoted drip plate motor 53 is actuated to lower the pivoted drip plate 28 to the position shown in phantom. By lowering the pivoted drip plate with the motor 53, contact between the drip plate 28 and the bottom of the basket 50 is avoided thereby preventing the bottom of the parts basket 50 from scratching the top of the plate 28 and contributing to contamination of the immersion chamber 16.

The parts basket motor is then actuated to lower the parts basket 50 into the immersion chamber 18 for an immersion interval. The parts basket motor is then reversed by motor drive means 58 to raise the parts basket back up into the vapor zone 19. The motor drive means 58 then releases the clutch of the cable drum 54. The counterweight 34 thereupon causes the pivoted drip plate 28 to rotate in a clockwise direction from its dotted line open position depicted in FIG. 7 to a closed position covering the immersion chamber 16 and indicated in solid lines as shown.

After draining, the parts are sprayed with solvent from spray bars 64. The roll top cover 60 is retracted by the motor drive means 58 for the second time. The parts basket is actuated to raise the parts basket from the vapor zone 19 to the freeboard area 16 above the closed position of the roll top cover 60. The motor drive means 58 then deactuates the roll top cover motor. The roll top cover motor is then disengaged to allow the roll top retractor 63 to close the top cover 60 as the cycle is completed.

Figure 14:
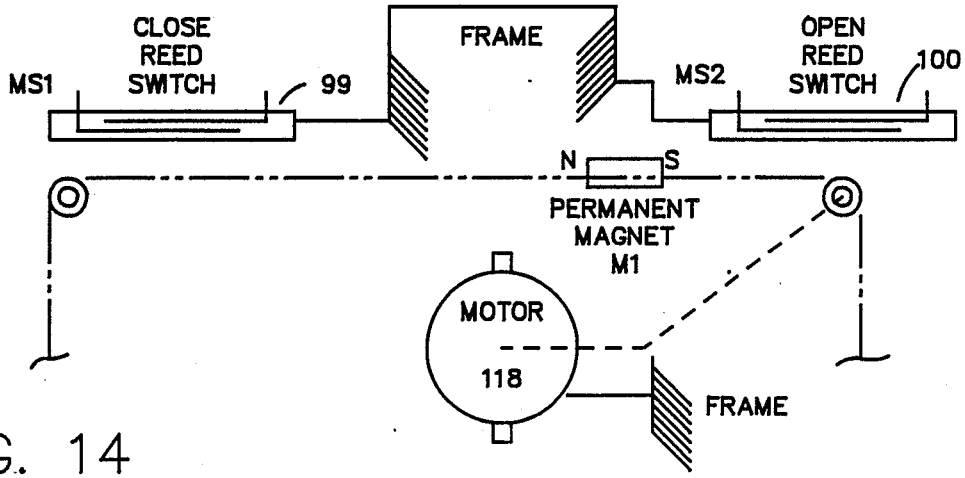
FIG. 14 is a schematic showing the use of reed limit switches and a magnet coupled to a cable.

Switches such as optical switches, magnetic switches of the type depicted in FIG. 14, and mechanical switches are contemplated for application in limiting the travel of plate operating cable 55 as well as the basket cable 59 and roll top cover cable 61.

The motor 53 may be a small fractional horsepower motor powered through an operator actuated power switch using 115 Vac, 60 Hz service, and operating with speed reduction gearing means. Alternatively, low speed direct current motors can also be employed.

Phantom block 65 in FIG. 8 represents any alternative conventional positioning means coupled to the drip plate 28 for moving the hinged drip plate 28 to cover the immersion chamber 16 at an angle sloping upwardly from the upright partition 14 over the immersion chamber 16 in response to the absence of an open signal provided on control signal path 66. The phantom block 65 is also intended to represent any conventional means for moving the drip plate 28 to an open position to expose said immersion chamber 16 in response to an open signal provided on signal path 66.

Block 67 represents a control means for providing the open and clutch release signals on control signal path 66. The control means 67 is understood to be a manual control means such as manually operated control switches or an automatic sequence controller. The use of an automatic sequence controller also contemplates controlling the speed of the respective motors. The speed of movement of the pivoted drip plate 28 is adjusted to avoid undue disturbance of the solvent in the immersion chamber.

The parts basket cable speed is adjusted to reduce the time of each operation while reducing vapor disturbance to minimize loss of solvent vapor. The desired basket cable speed is estimated to be optimal when adjusted to be in the range of eight to thirteen feet per minute while the basket moves between the solvent in the immersion chamber 16 and the vapor zone 19 and between two to four feet per minute while the basket is moving out of the vapor zone 19 and up to the level of the freeboard 26 where the cabinet is located. Speeds of approximately eleven feet per minute while in the solvent and eleven feet per minute while moving up out of the vapor zone 19 are acceptable.

Figure 9:
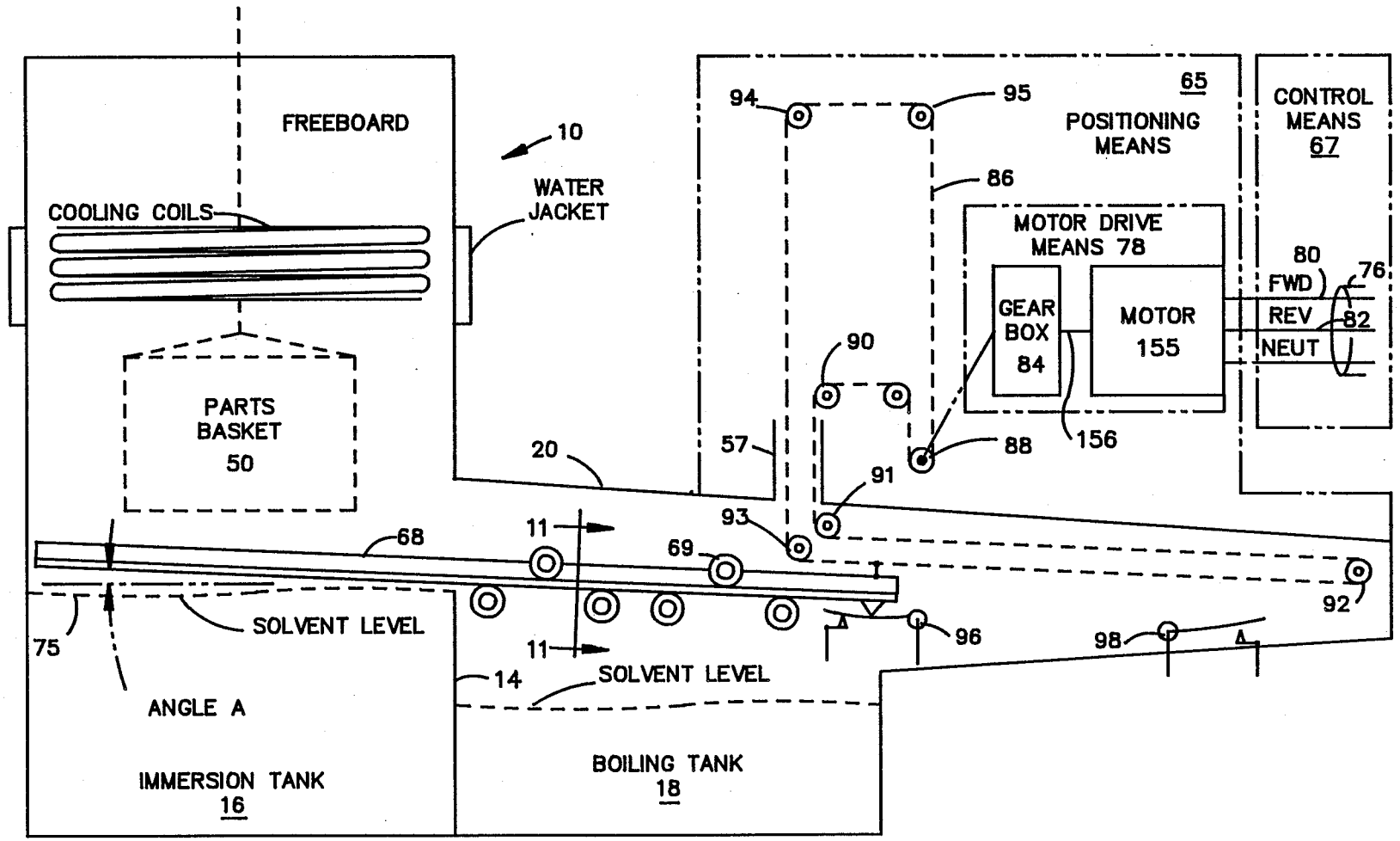
FIG. 9 is a side elevation view of a second embodiment of the invention using a sliding drip plate moved to the closed position and operated by a cable drive.
Figure 10:
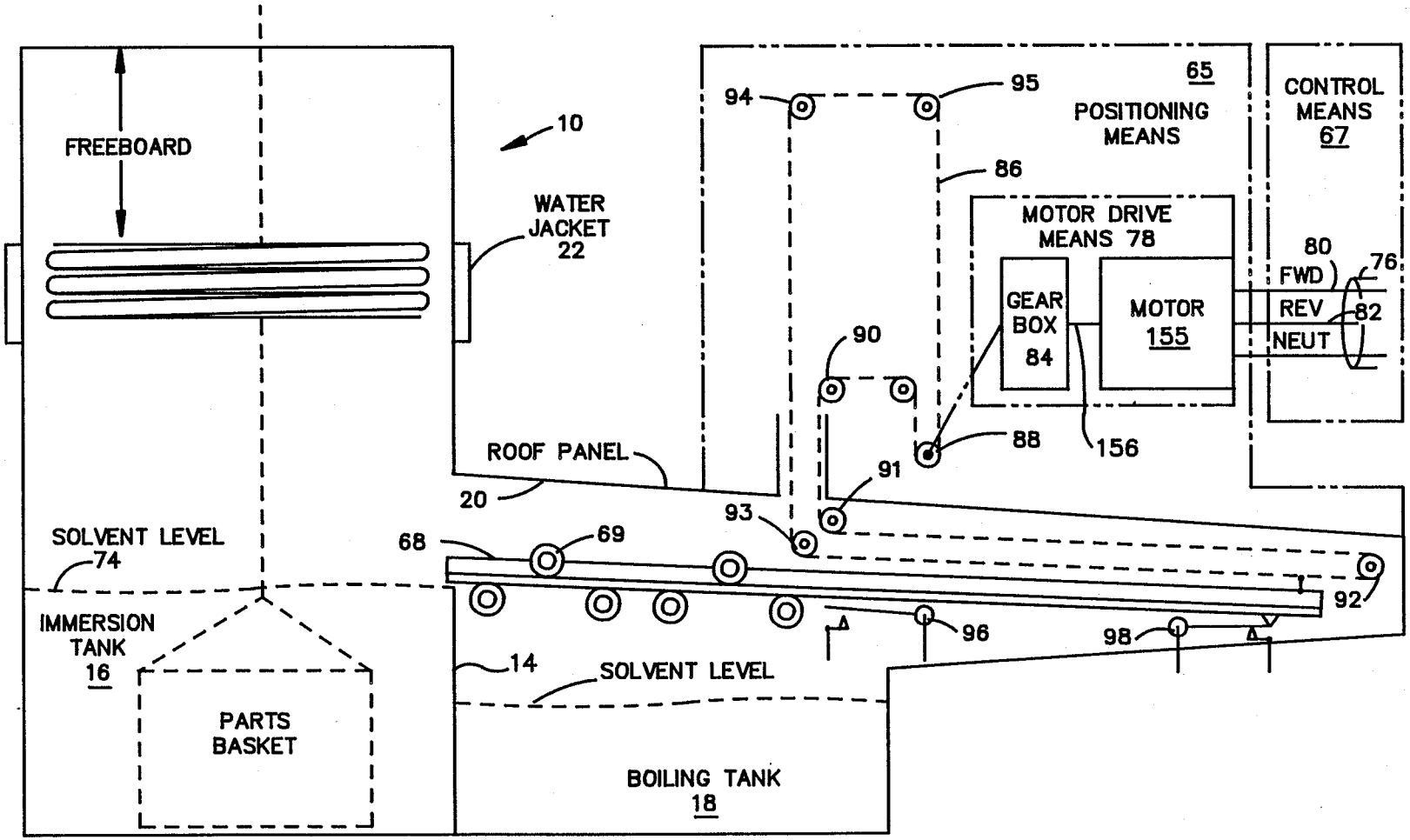
FIG. 10 is a side elevation view of the embodiment of FIG. 9 with the sliding drip plate shown in the open position.

FIGS. 9 and 10 depict an alternative embodiment of the invention immersion vapor degreaser 10 in two different states. A sliding drip plate 68 replaces the hinged drip plate of FIGS. 1–8. The sliding drip plate 68 is shown in the closed position in FIG. 9 and in the open position in FIG. 10.

Figure 11A:
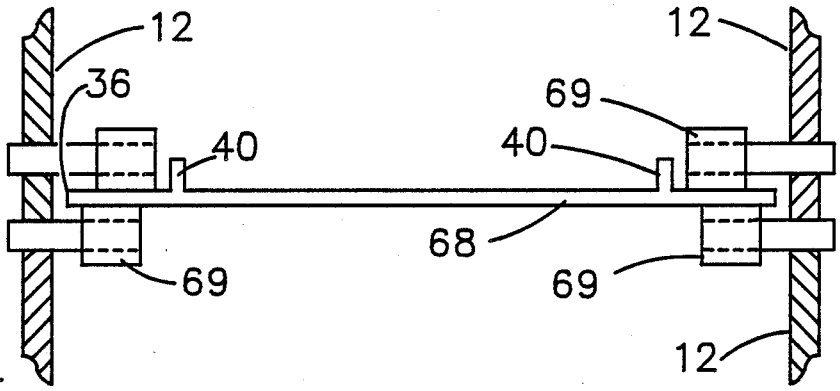
FIGS. 11*a*–11*d* are sectional views taken along the lines 11—11 of the sliding drip plate of FIG. 9 showing alternative embodiments of the slide and support means.

Alternative embodiments of a guide means for the sliding drip plate 68 are shown in section in FIGS. 11*a–11d*. FIG. 11*a* shows the drip plate 68 supported by rollers 69. The rollers 69 are pivotally coupled to the sides of tank 12 and guide the drip plate 68 to a closed or open position. Upturned lips 40 function as in FIG. 1, to prevent material that is draining onto the top of the drip plate 68 center region from flowing past the opposite edges 36 into the immersion chamber 16 The channeling lips 40 extend upwardly from the drip plate slab at or near the opposite edges 36. The sliding drip plate 68 is driven by a motor 155 and serves the same function as the pivotally supported drip plate 28 of FIGS. 1–8 but does not enter into the solvent in the immersion chamber 16.

Figure 11B:
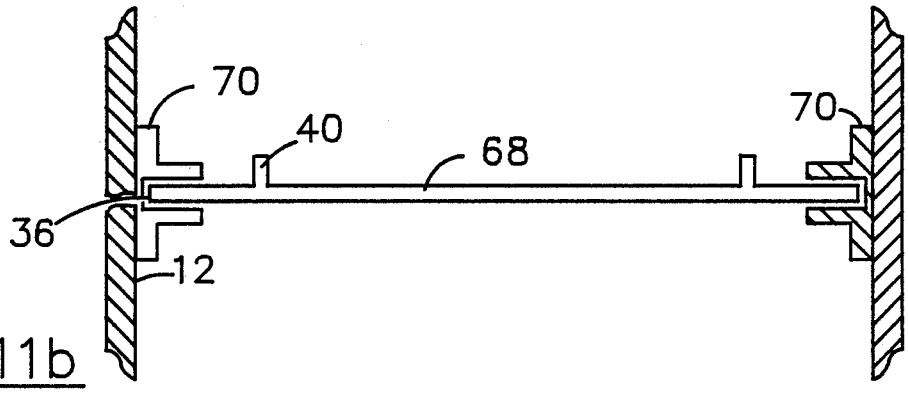

FIG. 11*b* shows an alternative guide means for slidably positioning the drip plate 68 above the partition 14. A guide means is used that has firs and second guide rails 70 coupled to the inner walls of the tank 12 in opposing parallel relation. The guides are channeled to receive the opposing edges 36 of the drip plate.

Figure 11C:
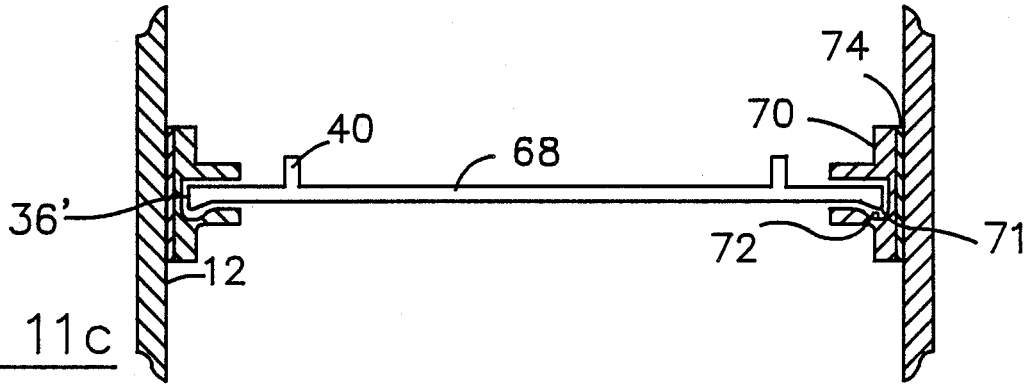
Figure 11D:
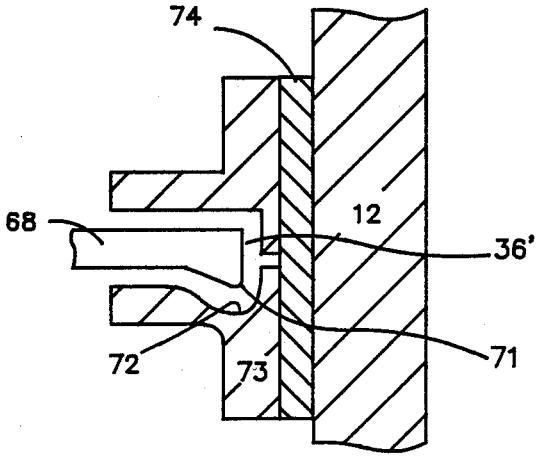

FIGS. 11*c* and 11*d* show an alternative embodiment of the guide means of FIG. 11*b*. The opposite transverse edges 36' of the drip plate 68 are rolled or shaped to form a flashing or drip edge 71 that is housed in a groove 72 that functions as a drain or weir and which is formed in the top of the lower slide guide 73. A gasket 74 is used to seal the guide means surface with the inner sides of the tank 12. The arrangement of FIG. 11*d* eliminates the gap that is present between the opposite transverse edges 36 of FIG. 11*a* and the inner walls of the tank 12. The elimination of this gap results in less contamination passing from the top of the drip plate 68 into the immersion chamber 16. FIG. 11*d* is an enlarged view of the guide means embodiment of FIG. 11*c* showing the drip edge 71, groove 72, lower slide guide 73 and gasket 74.

The sliding drip plate 68 of FIGS. 9 and 10 permits a positioning means 65 to move the plate into an open or closed position without the speed limitation imposed by immersion of the pivoted drip plate 28 in solvent as shown in phantom in FIGS. 6, 7 and 8. The sliding drip plate 68 of FIGS. 9 and 10 and 11*a–11d* reduces the amount of contaminants transferred from the top of the sliding drip plate 68 to the solvent since the drip plate is not submerged in the solvent as in the embodiments of FIGS. 6, 7 and 8.

The positioning means 65 of FIG. 8, 9 and 10 in all cases performs the function of positioning the drip plate 28 or the drip plate 68 in the open or closed positions in response to an open signal, or in the absence of an open signal, respectively. Each alternative embodiment of the positioning means 65 has a motor drive means 58 or 78 for rotating a motor drive shaft 156 in a first direction in response to a first motor command signal to drive the drip plate to a closed position and for allowing or operating the drip plate to return to the closed position in response to a second motor command signal, which may be a clutch release signal.

The positioning means 65 of FIGS. 9 and 10 slidably positions the drip plate 68 above the partition 14 to cover the immersion chamber 16 at an angle sloping upwardly from the partition 14 over the immersion chamber 16 in response to a control signal first state, such as a switch closure by an operator or a signal from a sequential controller. The angle A of the drip plate 68 is selected to be typically in the range of 2.5 to 15 degrees with respect to a horizontal reference. The positioning means 65 of FIGS. 9 and 10 slidably positions the drip paate to expose the immersion chamber 16 in response to a control signal second state such as a second operator switch closure or a second signal from a sequential controller.

FIGS. 9 and 10 show control means 67 providing a first motor command signal on the FWD signal line 80 to run the motor 155 in a direction to close the drip plate 68. A second motor command signal is provided on the REV signal line 82 to drive the drip plate 68 to the open position. Since the drip plate 68 is positively driven in opposite, reciprocal directions, the embodiment of FIGS. 9 and 10 does not require a counterweight.

Gear box 84, cable 86, drive pulley 88 and guide pulleys 90–95 represent a drive means for coupling the motor drive shaft to the drip plate 68 to move the drip plate 68 to a closed position in response to the drive shaft 156 rotating in a first direction and for moving the drip plate to an open position in response to the drive shaft 156 rotating in a second direction. The gear box 84 has an input shaft coupled to the motor drive shaft and an output shaft coupled to the drive pulley 88. The gear box 84 drives the drip plate control cable at a predetermined linear portion of speed of the motor 155 in response to actuation of the motor 155. Cable speed rates are empirically determined in accordance with the particular application. The cable speed is adjusted by the gear ratio in the gear box 84 and may be in the range of from one inch per second to three inches per second for small degreasers.

Figure 12:
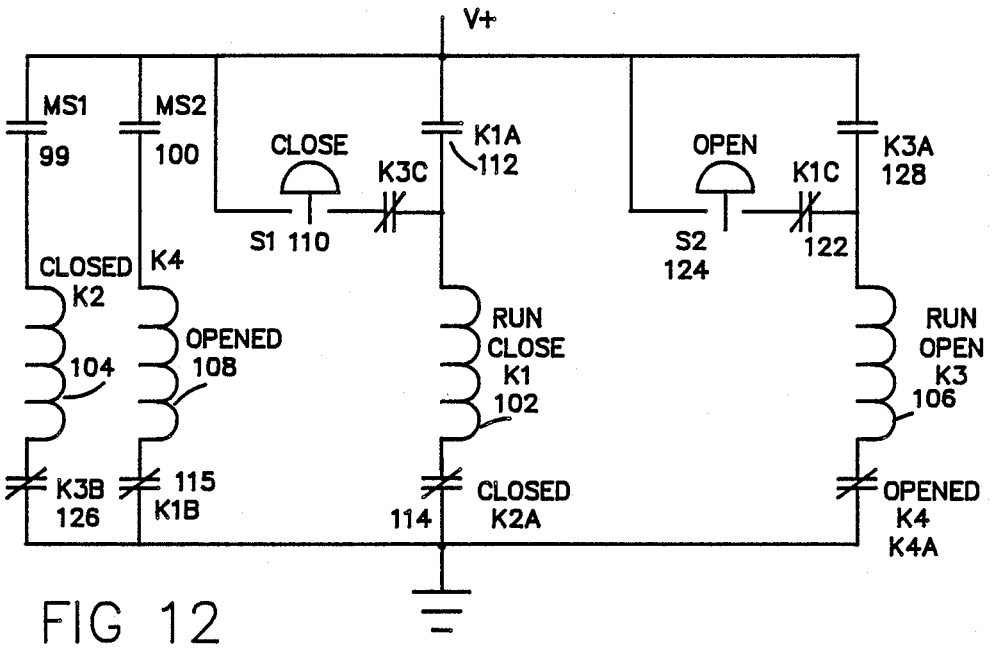
FIG. 12 is a schematic of the power control circuit to the motor from the control circuit of FIG. 12 using universal closure symbols of parallel bars to show normally open contacts and slashed parallel bars to indicate normally closed contacts.

Switches 96 and 98 shown in FIGS. 9 and 10 are limit switches such as MS1 and MS2 shown in FIGS. 12 and 14. These switches represent a limit switch means in the motor control circuit of FIGS. 12, 13 and 14.

The motor control circuit of FIGS. 9 and 10 can be controlled by a pair of limit switches such as switches 96, and 98 or by limit switches such as magnetic reed switches 99 and 100 in FIG. 14 for interrupting a first motor command signal to stop the drive shaft rotation in response to the drip plate 68 reaching the open or closed position. Switches 99 and 100 are positionally referenced to the frame or tank and eliminate machine timing problems associated with cable slippage. Magnetic reed switches operate well in gas or corrosive environments since they are typically sealed in glass.

Figure 13:
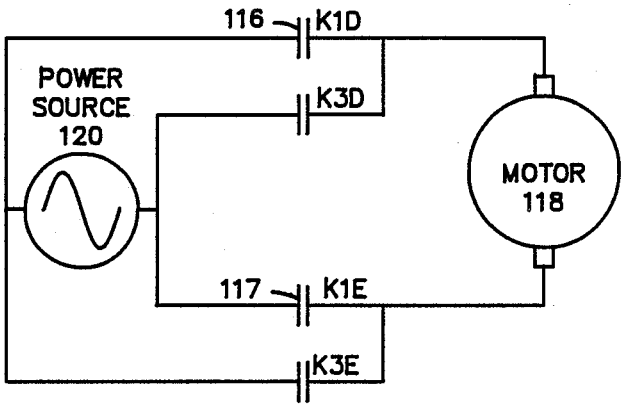
FIG. 13 is a schematic of the power control circuit for reversing the polarity of power applied to the motor under the control of the circuit of FIG. 12.

FIGS. 12, 13 and 14 are drawn using universal closure notation. Parallel lines represent a normally open contact or path that is closed only when tee relay is energized or true and parallel lines traversed by a slash represent a normally closed contact or path that is closed only when the relay is de-energized or false. Relay coils K1, 102 and K2, 104 control the close cycle. Relay coils K3, 106 and K4, 108 control the open cycle.

The limit switches can both be opened as power is first applied to the circuit as a result of the drip plate not being fully closed or open. All relays will be and will remain de-energized and power will not be applied to the motor unexpectedly. If the drip plate is at the opened or closed position, as power is applied, K2 or K4 will operate via MS1 or MS2 and lock out the respective run relay, K1 or K3.

To close the degreaser, the operator depresses the momentary open switch S1, 110. The run open relay K3 must be de-energized. K1 will energize and provide a hold path for itself through K1A, 112. K2A, 114 is de-energized because the drip plate 68 is moving to the closed position but has not reached the close position and closed MS1, 99.

With only a momentary depression of S1, 110, power will be applied to the motor through contacts K1D, 116 and K1E, 117 as shown in FIG. 13. The power applied to motor 118 from power source 120 will typically be 120 Vac, 60 Hz service but the circuit of FIGS. 12 and 13 will also work for a DC service. The motor 118 must be compatible with the service.

As the drip plate reaches the closed position, reed switch MS1, 99 closes and energizes K2, 104. K2A opens dropping K1 and stopping the motor. While K1 is energized, closure K1C, 122 inhibits the run open circuit for the coil of K3, 106 from being energized by an inadvertent depression of switch S2, 124. The interlocking operation of the circuit insures that coils Kl and K3 are never energized at the same time.

In the closed position, coil K2 remains energized until the operator depresses S2, 124 to direct the drip plate to open. Coil K3, 106 energizes in response to the closure of S2 and operation of K3 opens the return path for coil K2, 104 via closure K3B, 126. Coil K3, 106 is held energized via closure K3A, 128 until MS2 closes in response to the drip plate reaching a fully opened position. K4 energizes in response to closure of MS2 and de-energizes K3 106 by opening K4A. The coil K4 108 is locked out by contact K1B 115 whenever the run close relay coil K1 102 is energized. Operation of the open cycle is thereafter analogous to that of the previously described close cycle. Power is applied to motor 118 with polarity reversed via contacts K3D and K3E. If motor 118 had a forward winding (FWD) and a reverse winding (REV) and a neutral terminal, contacts K1E and K3E would be eliminated, K1D would be connected to the FWD terminal, K3D would be connected to the REV terminal, and the source would be returned to the neutral terminal for equivalent operation.

Figure 15:
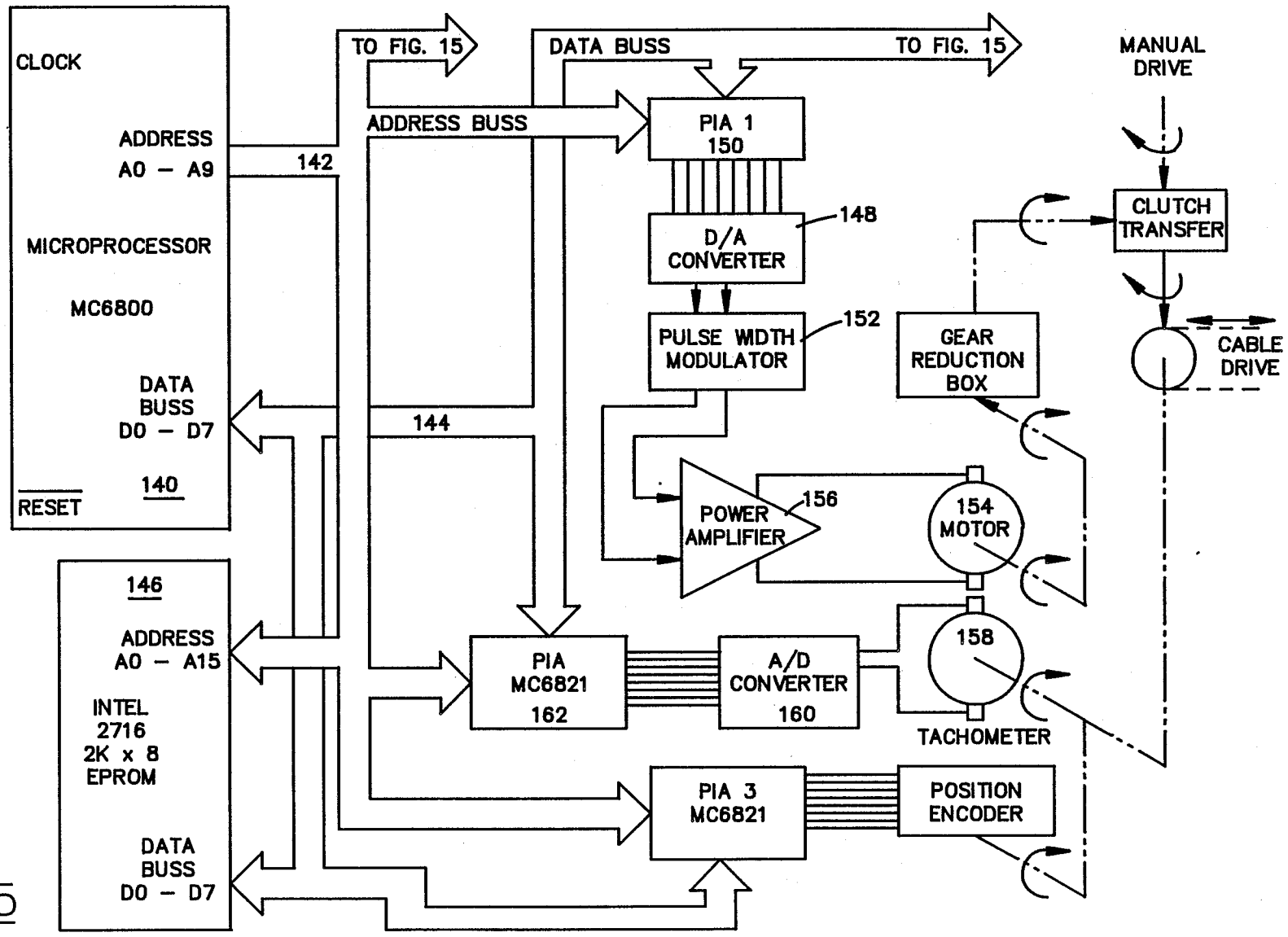
FIGS. 15 and 16 are the first and second half of a block diagram of a generalized microprocessor based controller for the motor drive means of FIGS. 8, 9 and 10.
Figure 16:
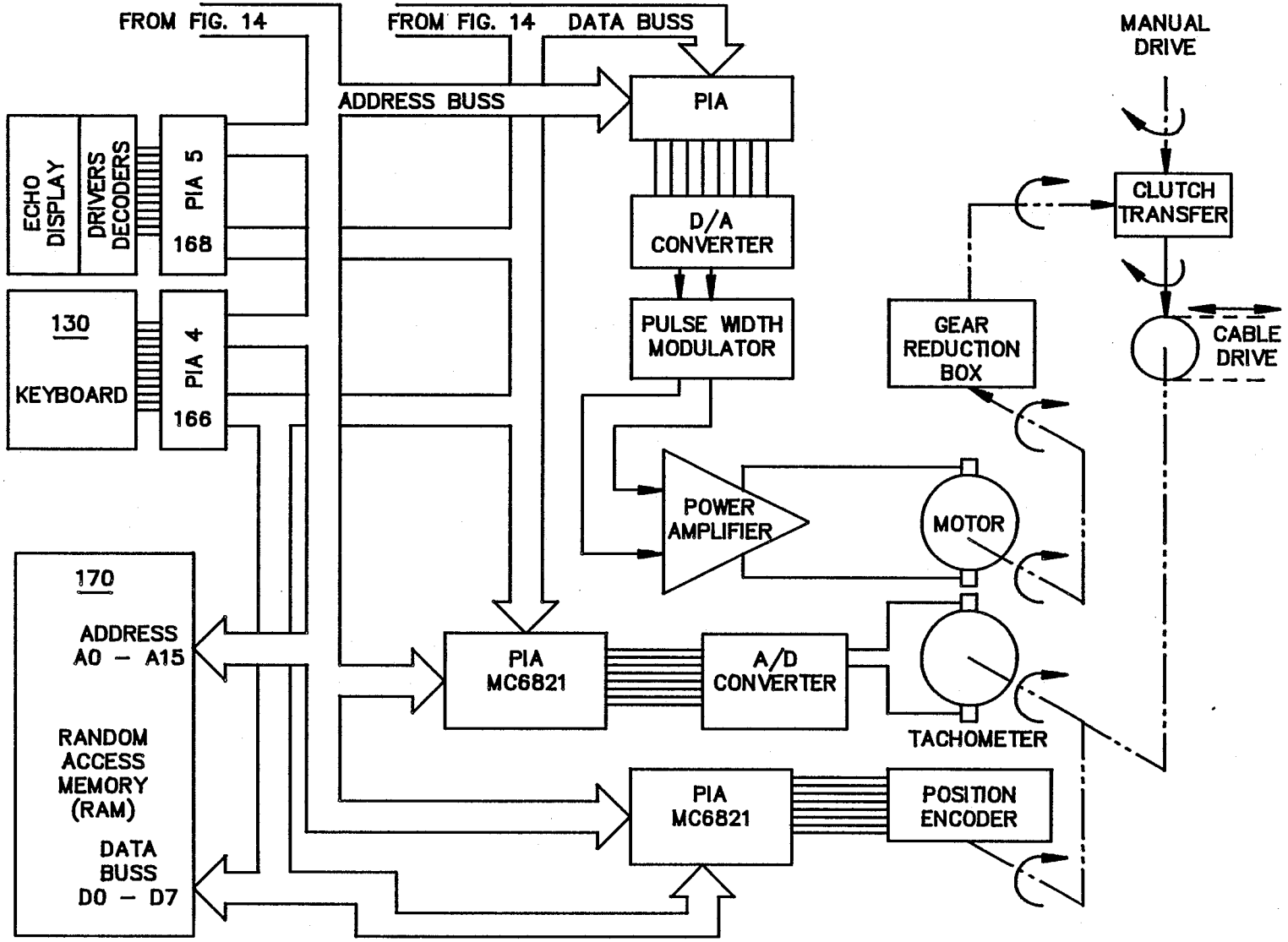

The depression of switch S1 to close the drip plate 28 or 60 or the depression of S2, 124 to open the drip plate are functions that can alternatively provided by an alternative signal means which might reasonably include the closure of semiconductor switches driven be a microprocessor system as a control means such as shown in FIGS. 15 and 16 and which is controlled by program as outlined in the block diagrams of FIGS. 17, 18, 19 and 20.

The motor 155 in the motor drive means 78 of the embodiments of FIGS. 8, 9 and 10 could be designed to integrate the functions of the circuit of FIGS. 12 and 13 to provide a motor responsive to a first and second motor command signal equivalent in function to the closures of switches S1 110 or S2, 124 or their semiconductor equivalents for driving a motor shaft in respective first and second directions.

The control means 67 for each of the alternative embodiments of FIGS. 8 and 9 requires a timing means for controlling the interval between events. The enablement provided by the microprocessor system of FIGS. 15 and 16 and which is controlled by a program as outlined in the block diagrams of FIGS. 15, 16 17 and 18 controls the time between events in the degreaser cleaning process for successive batch loads of parts where the cleaning process must be controlled to insure a minimum level of contamination.

FIG. 16 shows that the timing means has a keyboard 130 that responds to operator initialization for accepting and storing at least the time interval for each step in a sequence of steps for cleaning successive loads of parts. The intervals to be programmed include the time required for the steps of:

A. biasing or driving the drip plate toward a closed position to cover the immersion chamber, the drip plate being mounted on a horizontal axis above the top edge of a partition separating an immersion chamber from a boiling chamber, the drip plate being biased to drain solvent from its top surface into the boil tank;

B. positioning objects to be cleaned in a container above the immersion chamber and above the drip plate in its closed position to expose the container of objects to vapor rising from the boiling chamber for a first predetermined time interval, whereby vapor is condensed on the objects and falls onto tee drip plate and is returned to the boiling chamber;

C. moving the drip plate to its open position to expose the immersion chamber;

D. lowering the container of objects into the immersion chamber an waiting for a second predetermined interval;

E. raising the container out of the immersion chamber, and

F. returning the drip plate to the closed position.

The embodiment of FIGS. 1–8 requires that the drip plate portion 31 that extends out over the immersion chamber 18, have a length no greater than the elevation of the horizontal axis 32 upon which it is mounted above the bottom of the immersion chamber 16. This limitation is imposed because the drip plate 28 must be rotated into a position alongside the partition 14.

The positioning means 65 in the embodiment of FIG. 8 could provide positive drive to the pivoted drip plate 28 to raise the plate or to lower the plate as required thereby reducing the need for a counterbalance 34. The force required to operate the drip plate 28 is reduced by adjusting the mass or the position of the counterbalance 34 on the drip plate 28 above the boiling chamber 18. In the embodiment of FIGS. 1, 2, 6, 7 and 8 the counterbalancing strip 34 is formed as a flat strip extending downward from the slab and orientated perpendicular to the slab. With the release of tension on cable 55, counterbalance 34 provides sufficient torque to rotate the pivoted drip plate 28 to the closed position over the immersion chamber 16.

FIG. 7 and 8 show the use of a roll top cover 60 for covering the freeboard opening during periods when the parts basket 50 is lowered into the tank 12. Spray bars 64 are of rinsing the parts in the basket 50 after removal form the immersion chamber. These features are equally useful in the embodiment of FIGS. 9 and 10.

The embodiments of FIGS. 8 and 9 use substantially the same sequence of steps in cleaning parts as the embodiments of FIGS. 7 and 8 when equipped with a roll top cover and a means for raising the parts basket. The simplest control means for controlling the operation of the degreaser is formed by manually operating start and stop control such as S1, 110 and S2, 124 with a time piece to control the periods. More efficient operation is obtained using a sequence controller, such as the microprocessor systems of FIGS. 15 and 16 or an equivalent system such as a dedicated industrial controller or a dedicated personal computer with the required interface cards, to control the required timing functions. Each alternate equivalent system permits the operator to store variables, via a keyboard such as keyboard 130 t enter the time required for the individual steps in the cleaning process. The time for particular steps will vary in accordance with the types of parts to be cleaned, the contaminants to be removed, the condition and type of solvent and other variables.

The sequence controller enables the operator to control the duration of steps in the process and to either actuate a motor to proceed or to provide an operator with a signal indication to proceed to the next step.

The process or method can be extended to include the an additional step of: repeating the first to the last process steps sequentially as an automated cycle in which the timed duration of each step in a subsequent cycle equals the time spent in the same step in the preceding cycle.

FIGS. 15 and 16 depict an embodiment of a generalized microprocessor system to operate as a sequence controller for the invention apparatus and process. The microprocessor 140 receives instructions and provides data via address buss 142 and data buss 144. The program for the process steps of FIGS. 17–20 are stored in EPROM 146. Larger Read Only Memory storage devices can be used and faster microcomputers can be used for more elaborate control processes.

The microprocessor 140 communicates with an external device such as a switch or a D/A Converter (digital to analog converter) 448 by first sending an address on the address buss that corresponds to the target device. Programmable Interface Adapters such as PIA 1 150 are each assigned a unique address. When addressed, the PIA permits the microprocessor to send or receive data to the target device. The D/A Converter 148 is commanded to convert a digital number into an analog control voltage to control the pulse width modulator 152 to drive the motor. The output of the PIA is fixed until the microprocessor addresses it again. Use of PIA devices permits the microcomputer to control a large number of individual functions and to perform multiple servo positioning tasks. The cycle time of the program must characterized to match or exceed the band width of the control functions serviced by the microprocessor.

The circuit of FIGS. 15 and 16 show the elements, such as Position Encoders, Power Amplifiers, and Tachometers typically used in digital position servos and which can be used to move the drip plate, to control the roll top cover or to lower and raise the basket. Brushless dc motors are suited for operation in explosive environments. In FIG. 15, a brushless motor 154 is driven by pulses from power amplifier 156 in either a forward or reverse direction. Tachometer 158 provides a shaft rate signal via A/D converter 160 via PIA 162 to the microprocessor when the PIA is sampled. Position decoder 164 is coupled to the respective positioning shaft or cable and provides a digital signal representing the position of the controlled item to the microprocessor 140 via PIA 3 when addressed. A clutch transfer means is shown for manual operation as required.

FIG. 16 shows the elements in a second positional servo. Although a position encoder connected to a shaft is shown, it should be appreciated that a temperature transducer could be used to control temperature or a pressure transducer could be used to control pressure as required using convention control techniques. Keyboard 130 is shown coupled to PIA 4 and is operated by an operator or programmer to initialize changes in the process as required. PIA 5, 168 provided an echo to the operator to indicate that the microprocessor has received the command or data. A PIA can also be used to sample the condition or to acknowledge to position of switches S1, S2, MSl nd MS2 as required by the particular design. Random Access Memory 170 provides the program driven microprocessor with a scratch pad for computation and temporary memory.

Figure 17:
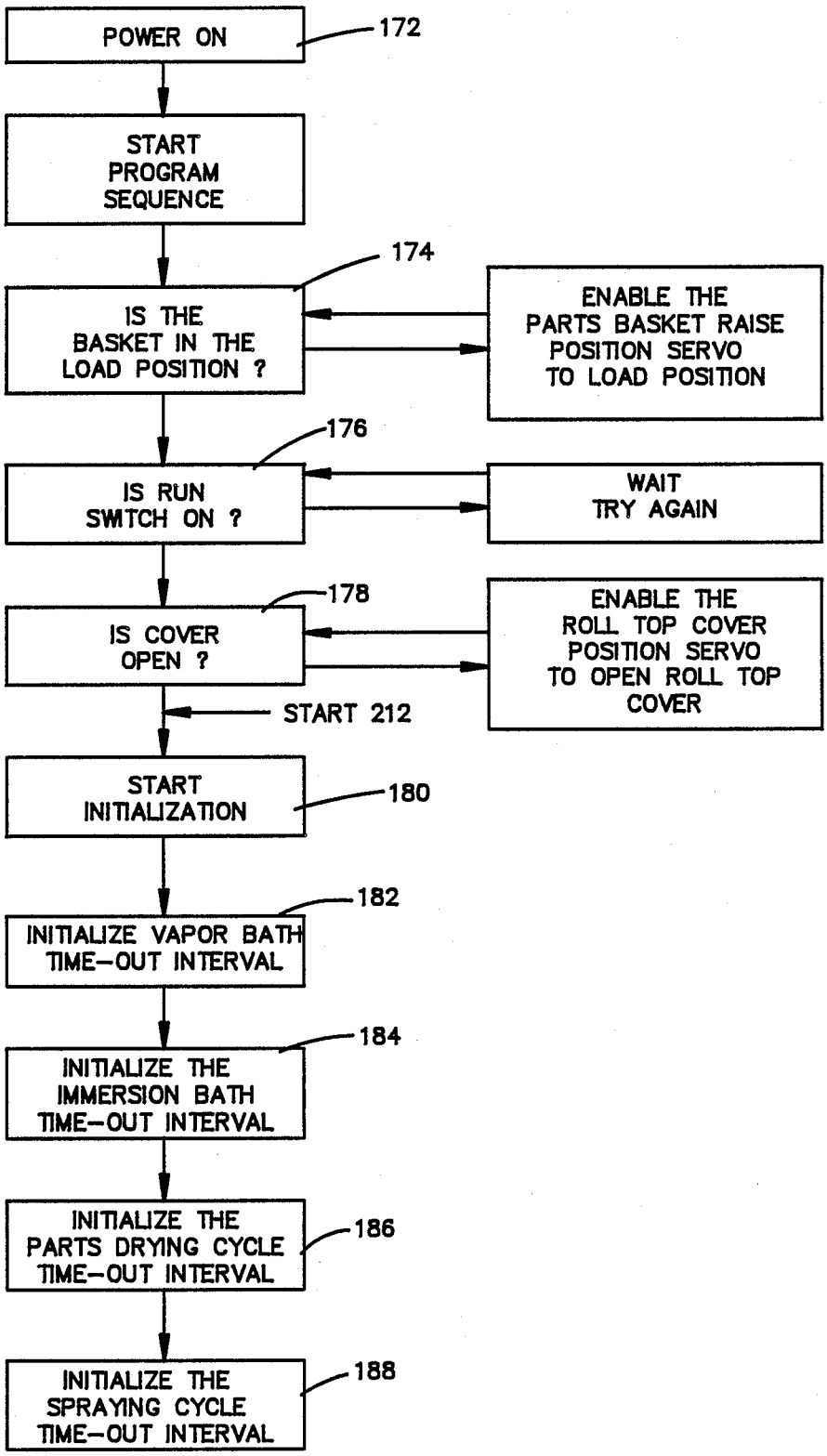
FIGS. 17–20 are a flow diagram for a program for the sequence controller of FIGS. 15 and 16 for controlling an automated degreaser.

The POWER ON block 172 in FIG. 17 represents the point of entry for the microprocessor program. The microprocessor would typically clean and initialize required memory locations in response to starting the sequence controller program at a predetermined memory location in EPROM 146. The program then advances to the IS THE BASKET IN LOAD POSITION ? block 172. The program causes the microcomputer to sample the PIA dedicated to the encoder position of the basket cable or to the limit switch assigned to indicate the position of the basket and provides the drive and control signals necessary to move the basket to the load position.

The program then advances to the IS RUN SWITCH IS 0N ? box 178 and waits in this state until the operator depresses the run button after filling the parts basket. The sequencer then advances to the IS COVER OPEN ? routine 178 and controls the opening to the roll top cover. The timers are initialized in the START INITIALIZATION routines 180–188 for the job being performed.

Figure 18:
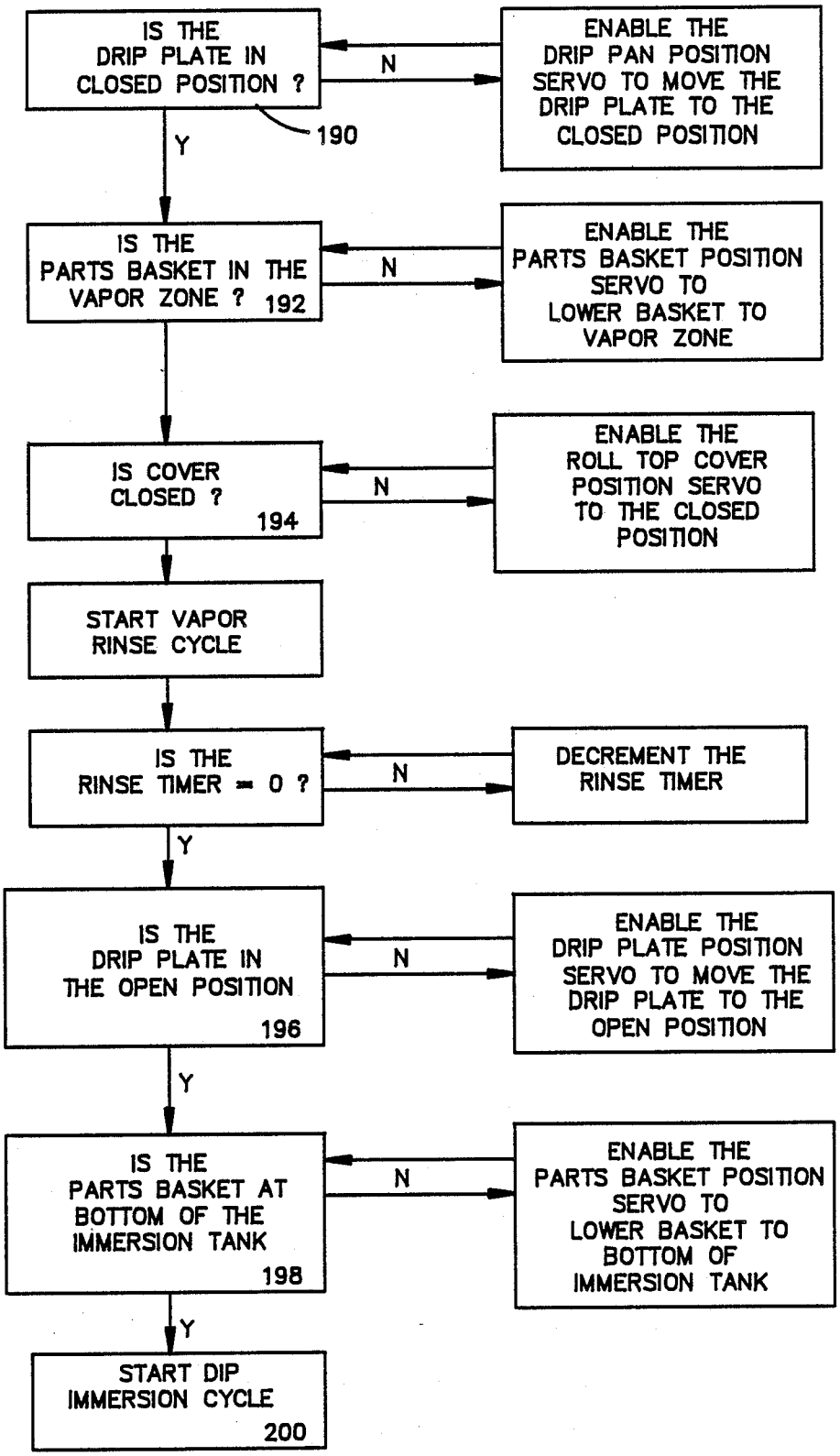

FIG. 18 shows the entry point to the IS THE DRIP PAN IN CLOSED POSITION ? routine 190. The microprocessor initiates the control signals required to move the pan to the required position and then advances to the IS THE PARTS BASKET IN THE VAPOR ZONE ? routine 192. The parts basket is driven to the predetermined position for vapor above the immersion chamber. The sequencer then advances to the IS THE COVER CLOSED ? routine and commands the required steps to close the roll top cover over the parts.

The vapor rinse cycle is then timed to its completion, and the sequencer advances to the IS THE DRIP PAN IN THE OPEN POSITION, 196 ? The respective servo is enabled and the drip pan is positioned to the open position.

Figure 19:
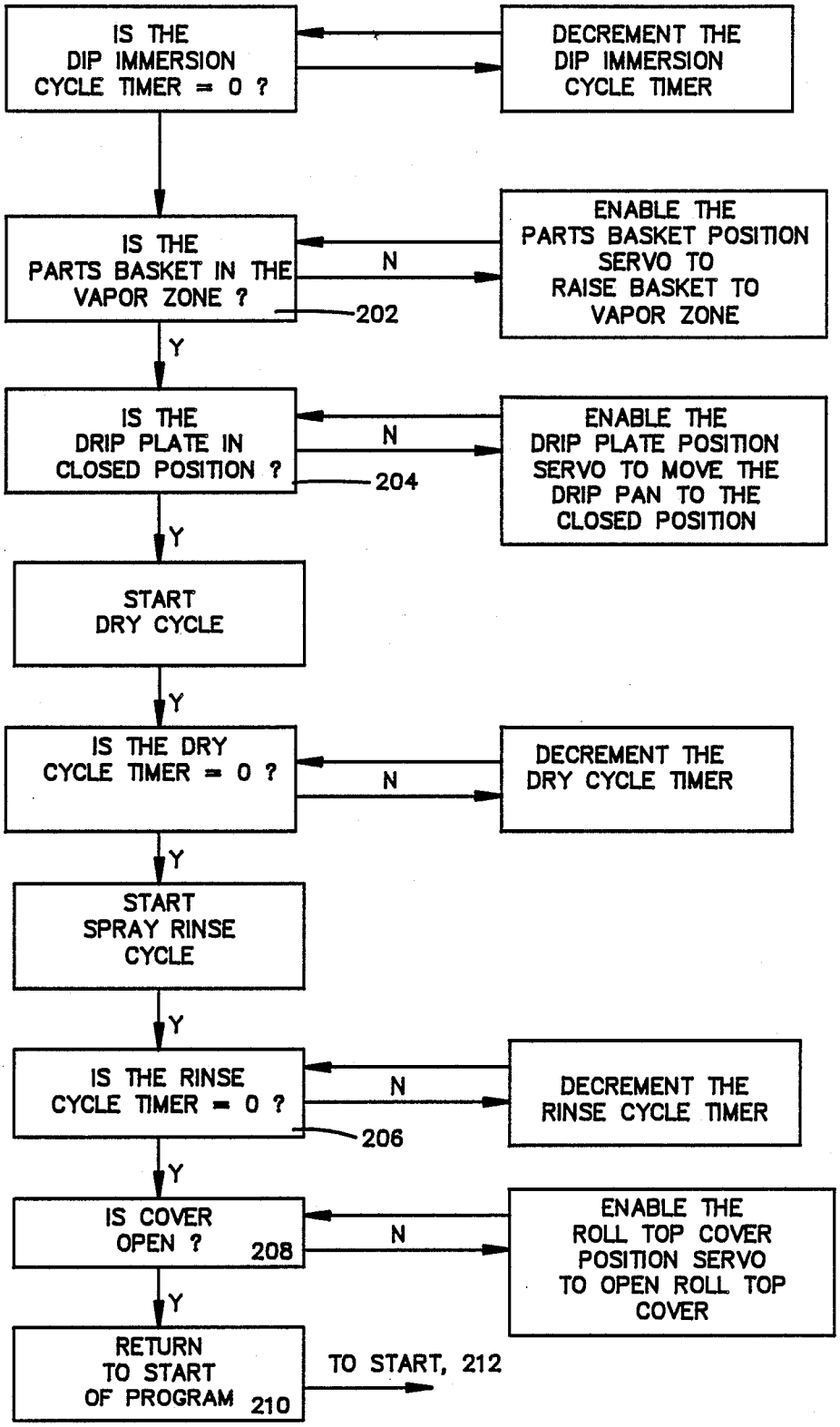

The parts basket is then lowered to the bottom of the immersion chamber by operation of routine 198, the dip cycle is timed by routine 200 and the basket servo is enabled to return the basket to the vapor zone by operation of routine 202 in FIG. 19. The drip plate is then positioned to the closed position again, by routine 204, a dry cycle is timed and a rinse cycle is completed through routine 206. Routine 208 open the roll top cover if one is used and routine 210 returns the program to its entry point at 212 on FIG. 15.

Figure 20:
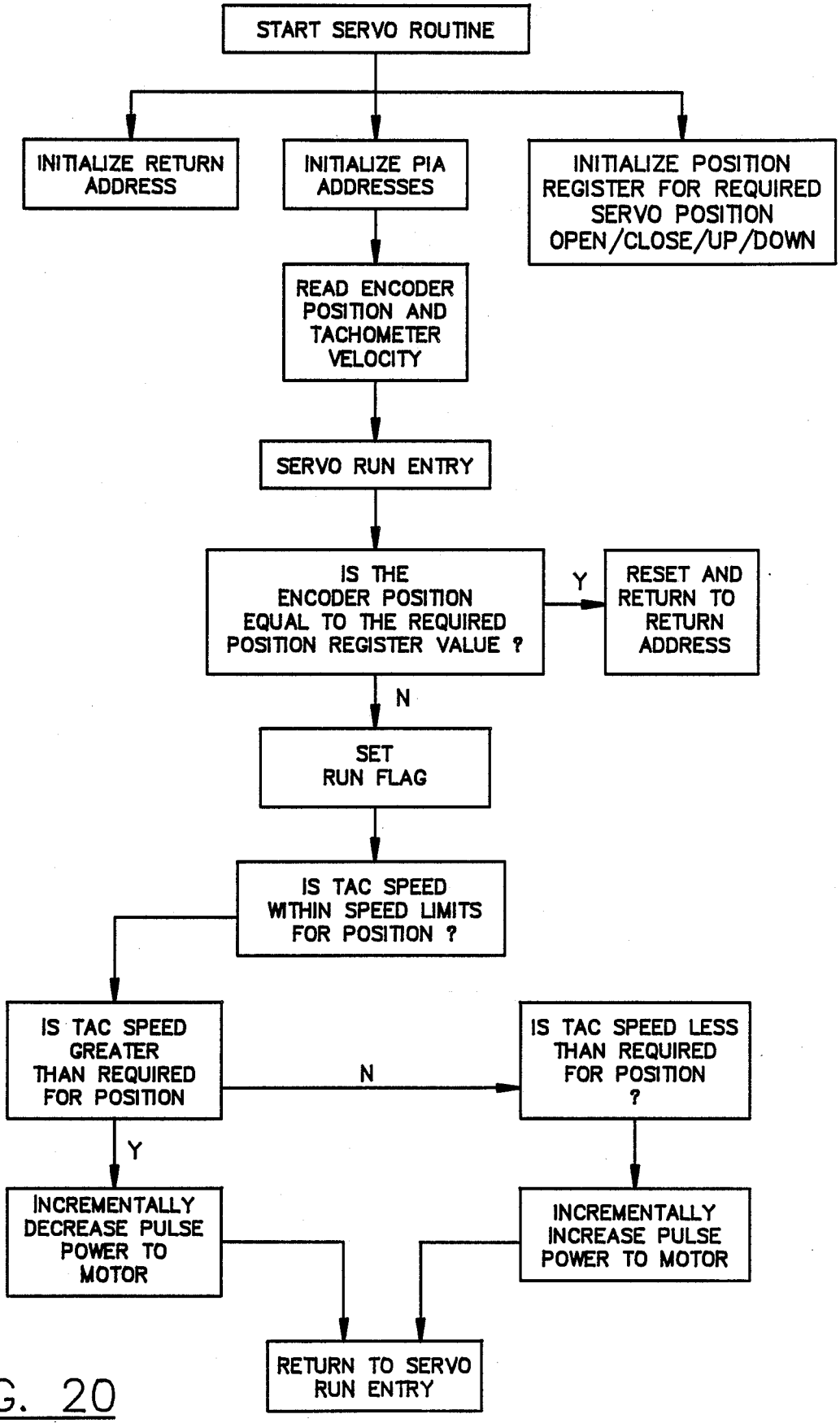

FIG. 20 is an embodiment of a positional servo routine for driving a motor and responding to both rate and position feedback information. The EPROM 146 can be initialized with the speed versus position curves to match the desired dynamics of the system. The output is a digital value to a PIA such as PIA 150 to control the width and polarity of pulses to brushless motor.

Undoubtedly, numerous variations and modifications of the invention will become readily apparent to those familiar with vapor degreasing devices and procedures. For example, a spring biasing mechanism could be substituted for the counterbalancing strip 34. Accordingly, the scope of the invention should not be construed as limited to the specific embodiment depicted and the specific manner of implementation described herein, but rather is defined in the claims appended hereto.

I claim:

1. An immersion type vapor degreaser comprising:

a tank divided by an upright partition into an immersion chamber and a boiling chamber and defining a vapor zone above said immersion chamber, a roof panel on said tank covering the top of said boiling chamber, condensation means located on said tank above said immersion chamber for condensing vaporized degreasing solvent, a drip plate positioned above said partition and beneath said vapor zone, control means for providing an open signal, and positioning means coupled to said drip plate for positioning said drip plate in a closed position to cover said immersion chamber at an angle sloping upwardly from said partition over said immersion chamber and beneath said vapor zone and responsive to said open signal for positioning said drip plate in an open position to expose said immersion chamber.

2. A vapor degreaser according to claim 1 wherein said positioning means coupled to said drip plate further comprises:

a motor for rotating a shaft in a first direction in response to said open signal, means for coupling said motor shaft to said drip plate to move said drip plate to said open position in response to rotation of said shaft in said first direction and for moving said drip plate to said closed position in response to an absence of said open signal, and limit switch means mounted in said tank and operable by said drip plate to halt rotation of said shaft in said first direction when said drip plate reaches said open position.

3. A vapor degreaser according to claim 1 wherein said positioning means further comprises:

a motor having a shaft and responsive to said open signal for driving said shaft in a first direction, cable means coupling said motor shaft to said drip plate to move said drip plate to said open position in response to rotation of said shaft in said first direction, and, counterweight means on said drip plate for urging said drip plate toward said closed position in the absence of said open signal.

4. A vapor degreaser according to claim 1 wherein said control means further comprises:

timing means responsive to operator initialization for accepting and storing at least the time interval for each step in a sequence of steps for cleaning comprising the steps of:

holding a basket of objects to be cleaned in said vapor zone and above said drip plate and above said immersion chamber and exposing said basket of objects to vapor rising from said boiling chamber, whereby vapor is condensed on said objects and falls onto said drip plate and is returned to said boiling chamber, moving said drip plate from said closed position to said open position, lowering said basket of objects into said immersion chamber, raising said basket out of said immersion chamber, and moving said drip plate from said open to said closed position, and wherein said control means provides said open signal to said positioning means to commence movement of said drip plate from said closed to said open position and terminates said open signal to commence movement of said drip plate from said open to said closed position.

5. A vapor degreaser according to claim 1 wherein said positioning means further comprises:

a motor responsive to said open signal for driving a shaft in a first shaft direction, and cable means coupling said motor shaft to said drip plate to move said drip plate to said open position in response to rotation of said shaft in said first shaft direction.

6. A vapor degreaser according to claim 5 wherein said drip plate is rotatably mounted on a horizontal axis above said partition and is rotatably movable between said open and closed positions, and further comprising counterbalancing means on said drip plate which returns said drip plate from said open to said closed position upon cessation of said open signal.

7. A vapor degreaser according to claim 6 wherein said cable means further comprises:

a reel coupled to said shaft, and a cable line secured to said reel and to said drip plate for rotating said drip plate in response to rotation of said reel, and a gear reduction means having an input shaft coupled to said motor shaft and an output shaft coupled to said reel, whereby said gear reduction means drives said cable at predetermined linear portion of speed of said motor in response to actuation of said motor by said open signal.

8. A vapor degreaser according to claim 7 wherein when said drip plate is in said closed position a portion of said drip plate extends from said partition out over said immersion chamber a distance no greater than the elevation of said horizontal axis above the bottom of said immersion chamber.

9. A vapor degreaser according to claim 8 wherein said drip plate is formed as a flat slab having channeling lips extending upwardly from said slab along said opposite edges perpendicular to said horizontal axis.

10. A vapor degreaser according to claim 8 wherein said counterbalancing means is formed as a flat strip extending downwardly from said slab and orientated perpendicular thereto.

11. A vapor degreaser according to claim 1 wherein said positioning means further comprises:

means for slidably reciprocating said drip plate above said partition to alternatively cover said immersion chamber at an angle sloping upwardly from said partition over said immersion chamber and for alternatively positioning said drip plate to expose said immersion chamber.

12. A vapor degreaser according to claim 11 wherein said positioning means further comprises:

first and second guide rails inclined at a predetermined angle with respect to horizontal, and coupled to the inner walls of said tank in opposing parallel relation above said partition, and said drip plate is formed as a flat slab having opposite edges orientated parallel to said guide rails so as permit solvent draining onto the top surface of said drip plate to drain into said boiling chamber.

13. A vapor degreaser according to claim 12 wherein said drip plate further comprises:

channeling lips extending upwardly from said slab along said opposite edges.

14. In an immersion type vapor degreaser having a tank defining a boiling chamber, an immersion chamber separated from said boiling chamber by an upright partition, and a vapor zone above said immersion chamber, the improvement comprising:

a roof on said tank extending over said boiling chamber at a distance above said partition, a drip plate coupled to said tank at a horizontal axis located above said partition and movable between a closed position in which a first portion of said drip plate extends at an incline away from said partition out over said immersion chamber and an open position exposing said immersion chamber, and positioning means coupled to said drip plate for alternatively positioning said drip plate in said closed and open positions, and motor means coupled to operate said positioning means.

15. A vapor degreaser according to claim 14 wherein said partition ha a top edge and said horizontal axis is located at said top edge of said partition, and wherein said drip plate is comprised of a flat slab having opposite edges extending outwardly from and perpendicular to said axis and channeling means at said opposite edges.

16. An immersion type vapor degreaser comprising:

a tank divided by an upright partition into an immersion chamber and a boiling chamber, and defining a vapor zone above said immersion chamber, a roof panel on said tank covering the top of said boiling chamber, condensation means located on said tank above said immersion chamber for condensing vaporized degreasing solvent, a drip plate positioned above said partition and beneath said vapor zone, an electric motor, and positioning means responsive to actuation of said electric motor and coupled to said drip plate for alternatively positioning said drip plate to cover said immersion chamber at an angle sloping upwardly from said partition over said immersion chamber and beneath said vapor zone and for positioning said drip plate in an open position to uncover said immersion chamber.

17. An immersion type vapor degreaser responsive to a control signal having a first and second state comprising:

a tank divided by an upright partition into an immersion chamber and a boiling chamber, a roof panel on said tank covering the top of said boiling chamber, condensation means located on said tank above said immersion chamber for condensing vaporized degreasing solvent, a drip plate pivotally mounted above said partition, and including a portion extending toward said immersion chamber, a counterweight attached to said drip plate to apply a restoring torque to urge said drip plate toward a closed position in which said drip plate portion extends out over said immersion chamber, a cable having a first end coupled to said drip plate and a second end secured to a cable retrieving drum, a motor responsive to actuation for driving said drum in a first direction to retract said cable and thereby move said drip plate to an open position extending down into said immersion chamber and responsive to deactuation to release said drum, thereby allowing said counterweight to restore said drip plate to said closed position.

* * * * *